US008763593B2

(12) United States Patent
Clarke

(10) Patent No.: US 8,763,593 B2
(45) Date of Patent: Jul. 1, 2014

(54) INTAKE AND EXHAUST CHAMBERS

(75) Inventor: John M. Clarke, Woodsboro, MD (US)

(73) Assignee: Motiv Engines, LLC, New York, NY (US)

( * ) Notice: Subject to any disclaimer, the term of this patent is extended or adjusted under 35 U.S.C. 154(b) by 72 days.

(21) Appl. No.: 13/483,101

(22) Filed: May 30, 2012

(65) Prior Publication Data

US 2013/0319385 A1 Dec. 5, 2013

(51) Int. Cl.

| | |
|---|---|
| ***F02B 23/08*** | (2006.01) |
| ***F01B 7/20*** | (2006.01) |
| ***F02B 75/18*** | (2006.01) |
| ***F01L 3/00*** | (2006.01) |

(52) U.S. Cl.

USPC ..... 123/657; 123/50 R; 123/52.1; 123/52.2; 123/52.5; 123/51 A; 123/188.1; 123/190.12

(58) Field of Classification Search

USPC ..... 123/50 A, 50 B, 50 R, 51 A, 51 B, 52.3, 123/52.2, 52.5, 445

See application file for complete search history.

(56) References Cited

U.S. PATENT DOCUMENTS

| | | | | |
|---|---|---|---|---|
| 4,977,864 A * | 12/1990 | Grant | ..... | 123/50 B |
| 5,448,979 A | 9/1995 | Clarke | | |
| 5,542,382 A * | 8/1996 | Clarke | ..... | 123/51 AA |
| 5,623,894 A * | 4/1997 | Clarke | ..... | 123/50 R |
| 8,381,691 B2 * | 2/2013 | Clarke | ..... | 123/51 R |
| 8,397,685 B2 * | 3/2013 | Lowi | ..... | 123/50 R |
| 2011/0100334 A1 * | 5/2011 | Clarke | ..... | 123/51 R |

OTHER PUBLICATIONS

International Search Report and Written Opinion prepared for PCT/US2013/041748; mailed Sep. 12, 2013.

* cited by examiner

*Primary Examiner* — Lindsay Low

*Assistant Examiner* — Tea Holbrook

(74) *Attorney, Agent, or Firm* — William P. O'Sullivan; Sheehan Phinney Bass + Green PA

(57) ABSTRACT

An engine has a stationary first body portion with one or more surfaces that define a portion of a fluid flow path through the engine. The stationary first body portion has a substantially cylindrical outer surface. A first piston assembly is configured to reciprocate relative to the stationary first body portion and to accommodate one or more second piston assemblies reciprocating inside and relative to the first piston assembly. The first piston assembly has an extension portion. The extension portion has a substantially cylindrical inner surface that defines a space to receive the stationary first body portion. One or more sealing elements are between the substantially cylindrical outer surface of the stationary first body portion and the extension portion of the first piston assembly.

30 Claims, 9 Drawing Sheets

INTAKE AND EXHAUST CHAMBERS

FIELD OF THE INVENTION

The present disclosure relates to intake and exhaust chambers for an internal combustion engine.

BACKGROUND

In an internal combustion engine, fuel and an oxidizing agent, such as air, undergo combustion in a combustion chamber. The resulting expansion of high pressure and high temperature gases applies a force to a movable component of the engine, such as a piston, causing the movable component to move, thereby, resulting in mechanical energy.

Internal combustion engines are used in a wide variety of applications, including, for example, automobiles, motorcycles, ship propulsion and generating electricity.

It is generally desirable for internal combustion engines to be compact and highly efficient.

SUMMARY OF THE INVENTION

In one aspect, an engine (e.g., a compact compression ignition (CCI) engine) has a stationary first body portion with one or more surfaces that define a portion of a fluid flow path through the engine. The stationary first body portion has a substantially cylindrical outer surface. A first piston assembly is configured to reciprocate relative to the stationary first body portion and to accommodate one or more second piston assemblies reciprocating inside and relative to the first piston assembly. The first piston assembly has an extension portion. The extension portion has a substantially cylindrical inner surface that defines a space to receive the stationary first body portion. One or more sealing elements are between the substantially cylindrical outer surface of the stationary first body portion and the extension portion of the first piston assembly.

In a typical implementation, the extension portion surrounds and reciprocates relative to the stationary first body portion when the first piston assembly reciprocates.

Additionally, in a typical implementation, one or more valves is provided to control fluid flow through the portion of the fluid flow path defined by the stationary first body portion. Moreover, the stationary first body portion, the first piston assembly, the one or more sealing elements and the one or more valves cooperate to define an air intake or exhaust chamber for the engine. The air intake or exhaust chamber for the engine typically has a volume that changes during engine operation as the first piston assembly reciprocates relative to the stationary first body portion. Additionally, one or more second piston assemblies typically include two second piston assemblies arranged as opposed pistons inside the first piston assembly. And, the engine further includes a combustion chamber inside the first piston assembly and between the two second piston assemblies.

The first piston assembly typically has a substantially annular wall that surrounds the combustion chamber and that defines a combustion chamber fluid port that extends in a substantially radial direction through the substantially annular wall. A curved shutter is outside the substantially annular wall. The curved shutter is movable in a circumferential manner about the substantially annular wall between a first position substantially blocking fluid flow through the combustion chamber fluid port and a second position not blocking fluid flow through the combustion chamber fluid port. An actuator is provided that causes the curved shutter to move between the first position and the second position in response to the first piston assembly reciprocating.

In some implementations, there are one or more circumferential grooves formed in the substantially cylindrical outer surface of the stationary first body portion. Typically, each of the one or more sealing elements is coupled to an associated one of the one or more circumferential grooves.

The substantially cylindrical outer surface of the stationary first body portion and the substantially cylindrical inner surface of the extension portion of the first piston assembly may share a common longitudinal axis. Moreover, in such implementations, the first piston assembly may be configured to reciprocate relative to the stationary first body portion along the common longitudinal axis.

In certain implementations, the first piston assembly has one or more surfaces that define a fuel injection passage. In those implementations, the engine may have a fuel injector that is stationary with respect to a casing of the engine and that extends at least partially through the fuel injection passage. The first piston assembly may be arranged to move in a reciprocating manner relative to the fuel injector.

In another aspect, an engine (e.g., a CCI engine) includes an engine casing and a first piston assembly configured to reciprocate relative to the engine casing. The first piston assembly is further configured to accommodate one or more second piston assemblies reciprocating inside and relative to the first piston assembly. A stationary first body portion is at an intake side of the first piston assembly. The stationary first body portion has one or more surfaces that define a portion of an air inlet path for the engine. The stationary first body portion has a substantially cylindrical outer surface. A first extension portion extends from the first piston assembly toward the stationary first body portion. The first extension portion has a surface that defines a substantially cylindrical inner space with an open top. The stationary first body portion extends at least partially through the open top and into the substantially cylindrical inner space of the first extension portion. One or more first sealing elements are between the substantially cylindrical outer surface of the stationary first body portion and the first extension portion of the first piston assembly. The first extension portion surrounds and reciprocates relative to the stationary first body portion when the first piston assembly reciprocates.

Certain implementations include a stationary second body portion at an exhaust side of the first piston assembly. The stationary second body portion has one or more surfaces that define a portion of an exhaust gas path for the engine. The stationary second body portion has a substantially cylindrical outer surface. A second extension portion is on the first piston assembly. The second extension portion has a surface that defines a substantially cylindrical inner space with an open top. The stationary second body portion extends at least partially through the open top and into the substantially cylindrical inner space of the second extension portion. One or more second sealing elements are between the substantially cylindrical outer surface of the stationary second body portion and the second extension portion of the first piston assembly. The second extension portion surrounds and reciprocates relative to the stationary second body portion when the first piston assembly reciprocates.

In some implementations, the exhaust side of the first piston assembly is opposite the intake side of the first piston assembly.

According to certain implementations, one or more intake valves are provided to control fluid flow through the portion of the air inlet path defined by the stationary first body portion and one or more exhaust valves are provided to control fluid flow through the portion of the exhaust path defined by the stationary first body portion.

In some implementations, the stationary first body portion, the first extension portion of the first piston assembly, the one or more first sealing elements and the one or more intake valves cooperate to define an air inlet/pre-compression chamber whose volume changes as the first piston assembly reciprocates relative to the engine casing. The stationary second body portion, the second extension portion of the first piston assembly, the one or more second sealing elements and the one or more exhaust valves cooperate to define an exhaust chamber whose volume changes as the first piston assembly reciprocates relative to the engine casing.

In certain implementations, the one or more second piston assemblies include two second piston assemblies arranged to form opposed pistons inside the first piston assembly. In some of such implementations, the engine may have a combustion chamber inside the first piston assembly that is between the two opposed pistons.

In some implementations, the first piston assembly includes a substantially annular wall that surrounds the combustion chamber and that defines a combustion chamber intake port and a combustion chamber exhaust port, each of which extends through the substantially annular wall; Moreover, a curved shutter is outside the substantially annular wall. The curved shutter may be movable in a circumferential manner about the substantially annular wall between a first position substantially blocking fluid flow through the combustion chamber intake port but not blocking fluid flow through the combustion chamber exhaust port, and a second position blocking fluid flow through the combustion chamber exhaust port but not blocking fluid flow through the combustion chamber intake port. Additionally, an actuator is provided that causes the shutter to move between the first position and the second position in response to the first piston assembly reciprocating.

One or more first grooves may be formed in the substantially cylindrical outer surface of the stationary first body portion and each of the one or more first sealing elements may be coupled to an associated one of the one or more first groove. Likewise, one or more second grooves may be formed in the substantially cylindrical outer surface of the stationary second body portion and each of the one of more second sealing elements may be coupled to an associated one of the one or more second grooves.

In some implementations, the substantially cylindrical outer surface of the stationary first body portion and the substantially cylindrical inner surface of the first extension portion of the first piston assembly share a first common longitudinal axis. Moreover, the first piston assembly is configured to reciprocate relative to the stationary first body portion cylindrical along the first common longitudinal axis. The substantially cylindrical outer surface of the stationary second body portion and the substantially cylindrical inner surface of the second extension portion of the first piston assembly share a second common longitudinal axis. Additionally, the first piston assembly is configured to reciprocate relative to the stationary second body portion cylindrical along the second common longitudinal axis. The first common longitudinal axis and the second common longitudinal axis can be identical (i.e., aligned with one another).

The first piston assembly may have one or more surfaces that define a fuel injection passage. Moreover, the engine may further include a fuel injector that is stationary with respect to a casing of the engine and that extends at least partially through the fuel injection passage. The first piston assembly may be arranged to move in a reciprocating manner relative to the fuel injector.

In some implementations, one or more of the following advantages are present.

For example, extremely compact, highly-efficient engines may be produced. In general, the engines may be about 25% the size of conventional engines of comparable power ratings. Additionally, the engines may be 22% to 32% more efficient than currently available diesel engines. Moreover, the engines may experience very low levels of vibration when operating. Moreover, the engines may have very low levels of mono-nitrogen oxides (NOx) emissions. Additionally, in some exemplary implementations, the engines may achieve a brake thermal efficiency of 52% or better. Also, the engines may be adapted to achieve compression ignition of natural gas, diesel, biofuels, jet-A, JP-8, and other fuels. In addition, in some implementations, the engines may be able to burn natural gas as a compression-ignition fuel. The engines can have a 40:1 compression ratio or better and a large bore to stroke ratio.

In some implementations, particularly those with a substantially cylindrical fixed intake head and/or substantially cylindrical exhaust head and a reciprocating first piston assembly with a corresponding substantially cylindrical opening, as shown, for example, in FIG. 6A and FIG. 6B, the air motion inside the engine is low and there is low transfer passage volume. These implementations may be smaller and lighter than similar implementations that have conical designs for the intake and/or exhaust chambers and considerably smaller and lighter than conventional engines having a comparable power rating. Moreover, these implementations provide a substantial amount of space inside the engine to accommodate poppet valves for intake and exhaust.

Additionally, coolant can be effectively delivered to a reciprocating piston assembly that has a combustion chamber inside the reciprocating piston assembly.

Other features and advantages will be apparent from the description and drawings, and from the claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1A:
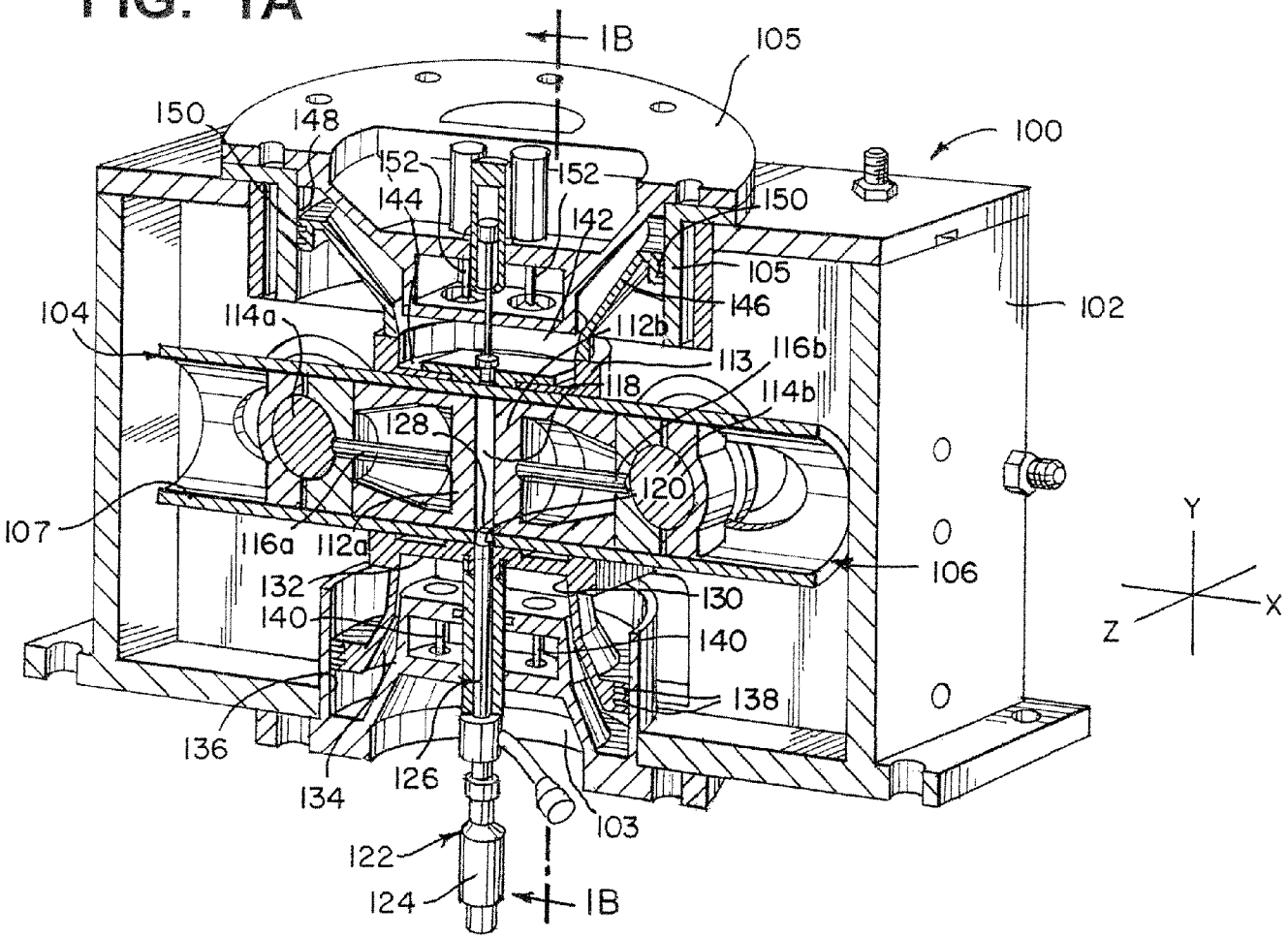
FIG. 1A is a cut-away perspective view showing an implementation of an engine.
Figure 1B:
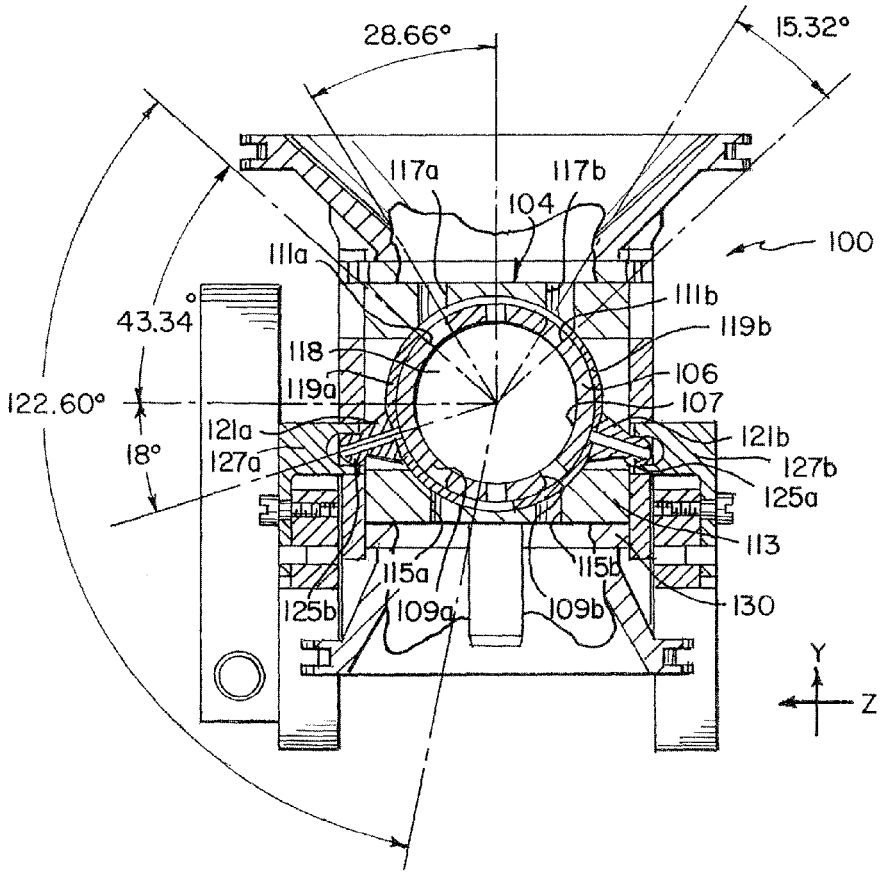
FIG. 1B is a partial cut-away view of the engine in FIG. 1A taken along lines 1B-1B.

FIG. 1A is a cut-away perspective view of an engine 100. FIG. 1B is a partial cut-away perspective view of the engine 100 taken along lines 1B-1B in FIG. 1A. Some of the internal components of the engine 100 are in a different position in FIG. 1B than they are in FIG. 1A.

The illustrated engine 100 includes a pair of opposed pistons 112*a*, 112*b* (also referred to as "high pressure pistons" or "high pressure piston assemblies") inside a substantially cylindrical chamber 106. Each opposed piston 112*a*, 112*b* is arranged to reciprocate during engine operation in a horizontal direction (i.e., along the x-axis in FIG. 1A) relative to the substantially cylindrical chamber 106. Moreover, the pair of opposed pistons define, in cooperation with the substantially cylindrical chamber 106, a combustion chamber 118 therebetween.

The substantially cylindrical chamber 106 is surrounded by a wall 107 that is part of a reciprocating piston assembly 104 (also referred to as "low pressure piston" or "low pressure piston assembly"). During engine operation, the low pressure piston assembly 104 reciprocates in a vertical direction (i.e., along the y-axis in FIG. 1A) relative to an engine casing 102.

Each high pressure piston 112*a*, 112*b* is coupled to an associated crankshaft 114*a*, 114*b*. Each crankshaft 114*a*, 114*b* translates the reciprocal motion of a respective one of the high pressure pistons into rotational motion. Additionally, movement of the high pressure pistons 112*a*, 112*b* about their respective crankshafts causes the low pressure piston 104 to reciprocate in the vertical direction (i.e., along the y-axis in FIG. 1A) relative to the engine casing 102.

In a typical implementation, each crankshaft 114*a*, 114*b* has one or more main bearing journals, each of which serves as a point of support for the crankshaft and one or more journals that serve as points of connection for the high pressure pistons. The crankshafts 114*a*, 114*b* rotate about their respective axes of rotation defined by their associated main bearing journals.

In the illustrated implementation, an (optional) high pressure piston oil cooling tube 116*a*, 116*b* extends through each high pressure piston as shown. In the illustrated implementation, oil for cooling is delivered through passages in the crankshafts 114*a*, 114*b* and through the high pressure piston oil cooling tubes 116*a*, 116*b* to help cool the high pressure pistons.

In FIG. 1A, each high pressure piston 112*a*, 112*b* is positioned at approximately top dead center, that is, where the piston crowns are closest to each other. In a typical implementation, the high pressure pistons 112*a*, 112*b* in a common substantially cylindrical chamber 106 reach top dead center at substantially the same time. To some degree, this arrangement helps balance the momentum of the high pressure pistons' individual momentums.

During operation, the high pressure pistons 112*a*, 112*b* reciprocate relative to the wall 107 of the chamber 106 along an axis that is perpendicular to the low pressure piston's axis of movement. In the illustrated implementation, for example, the high pressure pistons 112*a*, 112*b* reciprocate relative to chamber 106 along the x-axis, while the low pressure piston 104 reciprocates relative to the engine casing 102 along the y-axis.

The engine's combustion chamber 118 is located between the tops of the high pressure pistons 112*a*, 112*b* inside the chamber 106. When fuel ignites inside the combustion chamber 118, the resulting explosion and expansion of gases cause the high pressure pistons 112*a*, 112*b* to move apart from one another.

Since the combustion chamber 118 is inside the low pressure piston assembly 104 and since the low pressure piston assembly 104 reciprocates relative to the engine casing 102 when the engine is running, the combustion chamber 118 also reciprocates relative to the engine casing 102 when the engine is operating.

The low pressure piston assembly 104 has surfaces that define a passage 120 (or opening) that extends through the low pressure piston 104 and into the combustion chamber 118. The passage 120 has an inner diameter that is sized to enable a portion of a fuel injector 122 to extend through the passage 120 so that it can deliver fuel into the combustion chamber 118.

The fuel injector 122 is provided and includes a coupling portion 124 that can be coupled to a high pressure fuel delivery line (not shown in FIG. 1A), a sliding portion 126 that extends from the coupling portion 124 and a fuel injection nozzle 128 at a far end of the sliding portion 126. The fuel injector 122 has one or more internal passages that carry fuel from the high pressure fuel delivery line into the combustion chamber 118.

In a typical implementation, the sliding portion 126 of the fuel injector has a relatively smooth uniform outer surface that enables surfaces on the low pressure piston 104 to slide along the sliding portion 126 of the fuel injector as the low pressure piston 104 reciprocates relative to the engine casing 102. In some implementations, the outer surface of the sliding portion 126 is substantially cylindrical and the passage 120 in the low pressure piston 104 is substantially cylindrical as well.

In the illustrated implementation, both the passage 120 into the combustion chamber 118 and the sliding portion 126 of the fuel injector 122 that extends through the passage 120 are substantially cylindrical in shape. Moreover, both the passage 120 into the combustion chamber 118 and the sliding portion 126 of the fuel injector 122 that extends through the passage 120 have substantially uniform dimensions along their entire lengths.

In the illustrated implementations, the fuel injector 122 is arranged so that its sliding portion 126 extends at least partially into the passage 120 in the low pressure piston 104. The sliding portion 126 is able to accommodate reciprocating movement of the low pressure piston.

The fuel injector 122 is supported in such a manner that, when the engine 100 is operating, the fuel injector 122 remains substantially stationary relative to the engine casing 102. The illustrated fuel injector 122, for example, is directly coupled to the engine casing 102. It is generally desirable that the fuel injector 122 remain stationary relative to the engine casing 102 when the engine is operating, even though the combustion chamber 118 is moving relative to engine casing 102 because the high pressure fuel delivery lines (not shown in FIG. 1A), which deliver fuel to the fuel injector 122 and which usually are quite rigid, can be readily coupled to the fuel injector 122 if the fuel injector 122 remains stationary when the engine is operating.

Typically, an annular seal (not visible in FIG. 1A) is provided in the passage 120 and seals against the sliding portion 126 of the fuel injector 122 to prevent combustion gases from undesirably exiting the combustion chamber 118 through the space between the sliding portion 126 of the fuel injector 122 and the surfaces of the passage 120 when the engine 100 is operating.

The fuel injector 122 is arranged so that when the low pressure piston 104 moves in a reciprocating manner (along the y-axis in FIGS. 1A and 1B) relative to the fuel injector 122, the sliding portion 126 of the fuel injector 122 accommodates sliding motion of a surface of the passage 120 around the sliding portion 126. In a typical implementation, this relative sliding motion between the sliding portion 126 of the fuel injector 122 and the passage 120 results in the fuel injection nozzle 128 at the far end of the fuel injector's sliding portion moving relative to the low pressure piston 104 deeper into and further out of the combustion chamber 118.

The fuel injector 122 is arranged to inject fuel into the combustion chamber 118 at appropriate times during the engine's operating cycle to support appropriately timed fuel combustion inside the combustion chamber 118.

An intake cylinder head 103 is coupled to a lower portion of the engine casing 102 and an exhaust cylinder head 105 is coupled to an upper portion of the engine casing 102.

An air intake/pre-compression chamber 130 is located inside the engine casing 102 between the stationary intake cylinder head 103 and the reciprocating low pressure piston 104. More particularly, the air intake/pre-compression chamber 130 is bounded by a bottom surface 132 of the low pressure piston 104, by a flared wall 134 that extends downward from the bottom surface 132 of the low pressure piston 104 and by an inner surface 136 of the intake cylinder head 103.

A pair of annular grooves 138 is formed in an outer surface of the flared wall 134 near a far end thereof. In a typical implementation, each groove 138 accommodates a piston ring (not shown). As the low pressure piston 104 moves up and down (i.e., along the y-axis in FIG. 1A) relative to the engine casing 102, the piston rings slide against (or near) the inner surface 136 of the intake cylinder head 103. In general, the piston rings help reduce undesirable leakage of air out of the air-intake/pre-compression chamber 130 when the engine is operating.

Engine air intake valves 140 are provided in the intake cylinder head 103 and are operable to control air flow into the air intake/pre-compression chamber 130. The engine air intake valves 140 can be spring-loaded, for example, and are generally operable to allow air to be drawn into the air intake/pre-compression chamber 130 at appropriate times during the engine's operating cycle.

An exhaust/expansion chamber 142 is located inside the engine casing 102 between the stationary exhaust cylinder head 105 and the reciprocating low pressure piston 104. Similar to the air-intake/pre-compression chamber 130, the exhaust/expansion chamber 142 is bounded by an upper surface 144 of the low pressure piston 104, by a flared wall 146 that extends upward from the upper surface 144 of the low pressure piston 104 and by an inner surface 148 of the exhaust cylinder head 105.

A pair of annular grooves 150 is formed in an outer surface of the flared wall 146 near a far end thereof. In a typical implementation, each groove 150 is sized to accommodate a piston ring (not shown). As the low pressure piston 104 moves up and down relative to the engine casing 102, the piston rings slide against (or near) the inner surface 148 of the exhaust cylinder head 105. In general, the piston rings help reduce undesirable leakage of exhaust gases out of the exhaust/expansion chamber 142 when the engine is operating.

The contact (or close fit) between the piston rings and the inner surface 136 of the intake cylinder head 103 and the contact (or close fit) between the piston rings and the inner surface 148 of the exhaust cylinder head 105 also may help index (or regulate) the low pressure piston's orientation as it moves up and down inside the engine casing 102. In some implementations, the engine also has guide posts to help absorb side loads on these components.

Engine exhaust valves 152 are provided on the exhaust cylinder head 105 and are operable to control the flow of exhaust gases out of the exhaust/expansion chamber 142. The engine exhaust valves 152 can be spring-loaded, for example, and are generally operable to allow exhaust gases to exit the exhaust/expansion chamber 142 at appropriate times during the engine's operating cycle.

FIG. 1B is a partial cut-away perspective view of the engine 100 taken along lines 1B-1B in FIG. 1A. Some of the internal components of the engine 100 are shown in a different position in FIG. 1B than they are in FIG. 1A. For example, the low pressure cylinder 104 in FIG. 1A is at an approximate midpoint of its stroke, whereas the low pressure cylinder 104 in FIG. 1B is near the top of its stroke.

As shown in FIG. 1B, the wall 107 that surrounds the substantially cylindrical chamber 106 also has surfaces that define combustion chamber intake ports 109*a*, 109*b* and combustion chamber exhaust ports 111*a*, 111*b*.

In the illustrated implementation, each combustion chamber intake port 109*a*, 109*b* and each combustion chamber exhaust port 111*a*, 111*b* extends completely through the wall 107 in a substantially radial direction. The combustion chamber intake ports 109*a*, 109*b* are formed in a lower portion of the wall 107 and the combustion chamber exhaust ports 111*a*, 111*b* are formed in an upper portion of the wall 107.

In a typical implementation, the engine 100 includes two or more rows of combustion chamber intake ports and combustion chamber exhaust port, with each row including a pair of combustion chamber intake ports and a pair of combustion chamber exhaust ports (as shown in FIG. 1B). In such implementations, the rows may be displaced from one another in an axial direction (e.g., along the x-axis in FIG. 1A).

A block 113 is located outside and extends around the outer perimeter of the wall 107. The block can be virtually any shape or size. However, typically, and, as shown in the illustrated implementation, the block 113 has an inner surface that follows a substantially cylindrical path. Moreover, the inner surface of the block 113 surrounds and is outwardly displaced from the wall 107, thereby leaving an annular space between the block 113 and the wall 107 to accommodate one or more shutter elements 119*a*, 119*b*. The shutter elements 119*a*, 119*b* are generally operable to control fluid flow into or out of the combustion chamber 118.

The block 113 has surfaces that define intake passages 115*a*, 115*b* and exhaust passages 117*a*, 117*b*, each of which extends completely through the block 113. The intake passages 115*a*, 115*b* are formed in a lower portion of the block 113 and the exhaust passages 117*a*, 117*b* are formed in an upper portion of the block 113.

Each intake passage 115*a*, 115*b* in the block 113 is arranged so that it substantially (or at least partially) aligns with a corresponding one of the combustion chamber intake ports 109*a*, 109*b* in the wall 107. For example, intake passage 115*a* in block 113 substantially aligns with combustion chamber intake port 109*a* in wall 107. Additionally, intake passage 115*b* in block 113 substantially aligns with combustion chamber intake port 109*b* in wall 107.

Moreover, each exhaust passage 117*a*, 117*b* in block 113 is arranged so that it substantially (or at least partially) aligns with a corresponding one of the combustion chamber exhaust ports 111*a*, 111*b* in wall 107. For example, exhaust passage

117*a* in block 113 substantially aligns with combustion chamber exhaust port 111*a* in wall 107. Additionally, exhaust passage 117*b* in block 113 substantially aligns with combustion chamber exhaust port 111*b* in wall 107.

In a typical implementation, the number of intake passages in block 113 matches the number of combustion chamber intake ports in wall 107 and the number of exhaust passages in block 113 matches the number of combustion chamber exhaust ports in wall 107.

In the illustrated implementation, thin, curved shutter elements (also referred to as "shutters") 119*a*, 119*b* are provided in the annular space between the wall 107 and the block 103. In the illustrated implementation, each shutter 119*a*, 119*b* extends around part of, but less than the entirety of, the perimeter (e.g., circumference) of the wall 107. Moreover, each shutters 119*a*, 119*b* is shaped so as to substantially conform to the outer surface of the wall 107.

In a typical implementation, each shutter 119*a*, 119*b* is movable about the perimeter of the wall 107 between a first position substantially blocking fluid flow through one of the chamber exhaust ports but not blocking fluid flow through any of the chamber intake ports and a second position substantially blocking fluid flow through one of the chamber intake ports but not blocking flow through any of the chamber exhaust ports. In a typical implementation, each shutter is also movable to a third position substantially blocking fluid flow through one of the chamber exhaust ports and through one of the chamber intake ports. In FIG. 1B, for example, each of the shutters 119*a*, 119*b* is in the second position.

When a shutter is in the first position, an intake fluid communication path exists that includes one of the chamber intake ports and a corresponding one of the intake passages. Thus, when that shutter is in the first position, intake air is free to move through the intake path from the air intake/pre-compression chamber 130 to the combustion chamber 118. When a shutter is in the second position, an exhaust fluid communication path exists that includes one of the chamber exhaust ports and a corresponding one of the exhaust passages. Thus, when that shutter is in the second position, combustion gases are free to flow through the exhaust path out of the combustion chamber 118 and into the exhaust/expansion chamber 142.

In the illustrated implementation, the shutters 119*a*, 119*b* are arranged so as to move circumferentially around the wall 107 between the first, second and third positions. Each shutter 119*a*, 119*b* has an actuator 121*a*, 121*b* that facilitates moving the shutter between the first, second and third positions as the low pressure piston 104 reciprocates in the vertical direction (i.e., along the y-axis in FIGS. 1A and 1B).

More particularly, in the illustrated implementation, each actuator 121*a*, 121*b* is rigidly coupled to an outer surface of a corresponding shutter 119*a*, 119*b*, extends outward from that outer surface, extends through a slot or opening in block 113 and terminates at a ball joint 125*a*, 125*b* at a distal end of the actuator. In the illustrated implementation, each ball joint 125*a*, 125*b* allows its corresponding actuator to rotate freely about the joint housing 127*a*, 127*b*. Moreover, each ball joint allows its corresponding actuator to translate into or out of the joint housing 127*a*, 127*b* a small amount.

Each joint housing 127*a*, 127*b* is formed as part of a bulkhead that remains stationary relative to the engine casing 102 during engine operation.

FIGS. 2A-2F are cross-sectional side views of an engine 200, similar to the engine in FIGS. 1A and 1B, at various points during the engine's operations.

In these figures, a low pressure piston 204 is shown moving up and down in a reciprocating manner relative to an engine casing 202. Moreover, high pressure pistons 212*a*, 212*b* are shown moving toward one another and away from one another in a reciprocating manner inside the low pressure piston 204.

A fuel injector 222 is secured to the intake cylinder head 103, which is secured to the engine casing 202, so that as the low pressure piston 204 moves up and down, a sliding portion 226 of the fuel injector 222 slides through a passage 220 in the low pressure piston 204. Accordingly, in the illustrated implementation, the fuel injection nozzle 228 at the upper far end of the fuel injector 222 moves in and out of the engine's combustion chamber 218.

Figure 2A:
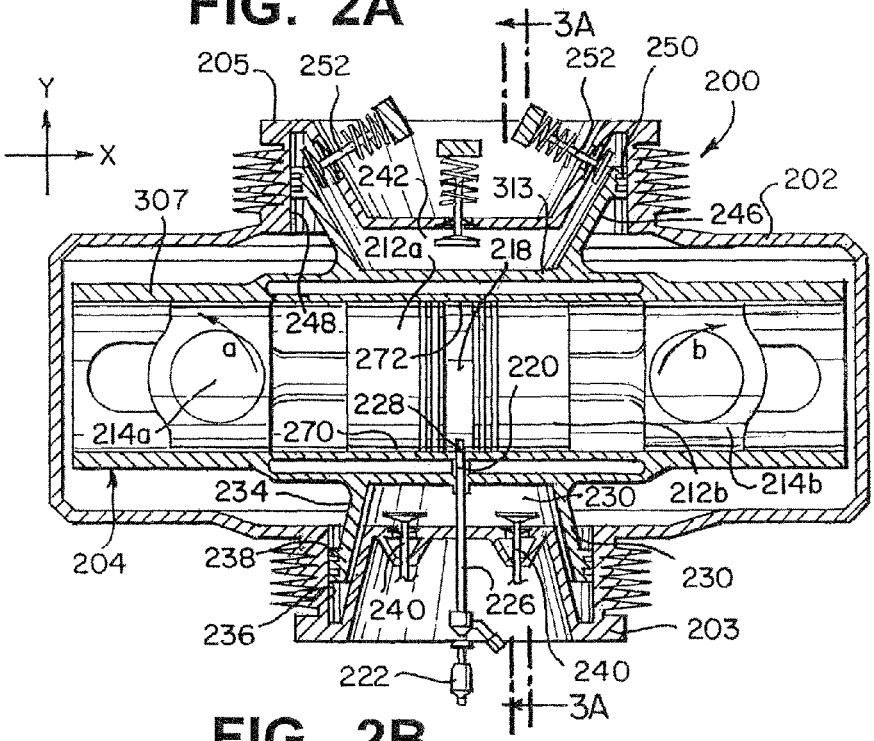
FIGS. 2A-2F are cross-sectional side views showing an implementation of an engine at various points during the engine's operating cycle.

In FIG. 2A, the low pressure piston 204 is shown approximately mid-stroke and moving upward. With the low pressure piston at this position, the fuel injection nozzle 228 at the far end of the fuel injector's sliding portion 226 extends into the combustion chamber 218 a short distance. The high pressure pistons 212*a* and 212*b* are located at approximately top dead center. In a typical implementation, the fuel injector 222 injects fuel into the combustion chamber 218 with the low pressure piston 204 and the high pressure pistons 212*a*, 212*b* positioned substantially as shown.

The injected fuel combines with air and ignites inside the combustion chamber 218. The ignition of fuel is substantially contained within the combustion chamber 218. The resulting explosion and expansion of combustion gases inside the combustion chamber 218 pushes the high pressure pistons 212*a*, 212*b* apart from one another. As the high pressure pistons 212*a*, 212*b* separate, crankshaft 214*a* rotates in one direction (indicated by arrow "a") and crankshaft 214*b* rotates in an opposite direction (indicated by arrow "b"). As the high pressure pistons 212*a*, 212*b* move apart from one another, the low pressure piston 204 moves in an upward direction relative to the engine casing 202.

In FIG. 2A, the engine air intake valves 240 are in an open position. In a typical implementation, the engine air intake valves 240 remain in an open position for substantially the entire time that the low pressure piston 204 is moving upward inside the engine casing 202. This allows air to flow into the engine through the engine air intake valves 240 while the low pressure piston 204 is moving upward.

Figure 3A:
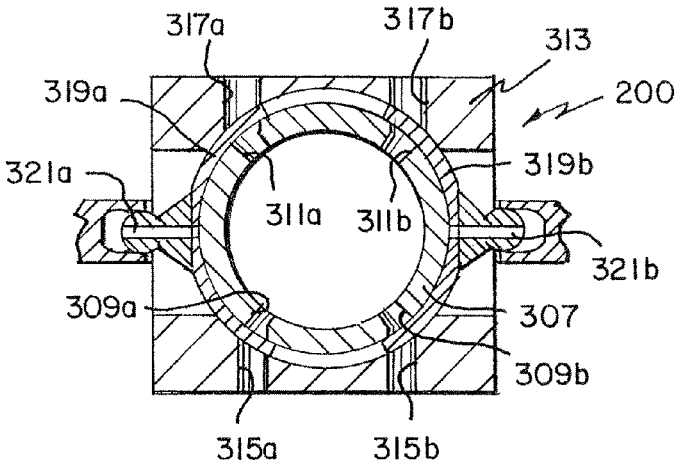
FIG. 3A-3C are partial cross-sectional views of the engine in FIGS. 2A, 2B and 2E, respectively, taken along lines 3A-3A, 3B-3B and 3C-3C.

FIG. 3A shows a partial cross-sectional view of the engine 200 in FIG. 2A. As shown in FIG. 3A, each shutter 319*a*, 319*b* is positioned so that it substantially blocks fluid flow through an air path into the combustion chamber and an exhaust path out of the combustion chamber.

For example, shutter 319*a* in FIG. 3A is blocking fluid flow through a path that would include combustion chamber intake port 309*a* in wall 307 and intake passage 315*a* in block 313. Shutter 319*a* is also blocking fluid flow through a path that would include combustion chamber exhaust port 311*a* in wall 307 and exhaust passage 317*a* in block 313. Similarly, shutter 319*b* in FIG. 3A is blocking fluid flow through a path that would include combustion chamber intake port 309*b* in wall 307 and intake passage 315*b* in block 313. Shutter 319*b* is also blocking fluid flow through a path that would include combustion chamber exhaust port 311*b* in wall 307 and exhaust passage 317*b* in block 313.

The shutter arrangement in FIG. 3A helps prevent the combustion gases that are expanding inside the combustion chamber 218 from escaping into either the air-intake/pre-compression chamber 230 or the exhaust/expansion chamber 242.

In general, during engine operation, when a shutter is positioned such that it blocks (or covers) a fluid flow path and there is a pressure differential across that shutter, then the shutter may flex in a direction dictated by the pressure differential. This, in some instances, will help the shutter seal the corresponding fluid flow path. Therefore, in FIG. 3A, for example, if the pressure inside the combustion chamber is greater than the pressure in the air-intake/pre-compression chamber and greater than the pressure in the exhaust/expansion chamber, then the shutters 319*a*, 319*b* may, at least in some instances, flex slightly outward to seal tightly against the corresponding passages formed in the block 313.

As the low pressure piston 204 moves upward inside the engine casing 202 (e.g., from its position in FIG. 2A to its position in FIG. 2B), piston rings, which are contained in grooves 238 in the outer surface of flared wall 234, remain in contact with or at least very close to the inner surface 236 of the intake cylinder head 203. This substantially seals the air-intake/pre-compression chamber 230 from other areas around the low pressure piston 204 inside the engine casing 202. As such, the low pressure piston's upward motion tends to create a low pressure environment within the air-intake/pre-compression chamber 230. This helps draw air into the air-intake/pre-compression chamber 230 from the engine's ambient environment.

In FIG. 2A, the engine's exhaust/expansion chamber 242 contains exhausted combustion gases from an earlier combustion event that occurred in the combustion chamber 218. The engine's 200 exhaust valves 252 are in an open position, which enables the combustion gases inside the exhaust/expansion chamber 242 to exit the engine 200 as the low pressure piston moves upward in the engine casing. In a typical implementation, the exhaust valves 252 remain in an open position for at least part of the time that the low pressure piston 204 is moving upward inside the engine casing 202.

As the low pressure piston 204 moves upward inside the engine casing 202, the piston rings, contained in the grooves 250 formed in the outer surface of the of the flared wall 246, remain in contact with or at least very close to the inner surface 248 of the exhaust cylinder head 105. This substantially seals the engine's exhaust/expansion chamber 242 from other areas of the engine inside the engine casing 202. The low pressure piston's upward motion when the engine's exhaust valves 252 are open helps push combustion gases out of the engine 200.

Figure 2B:
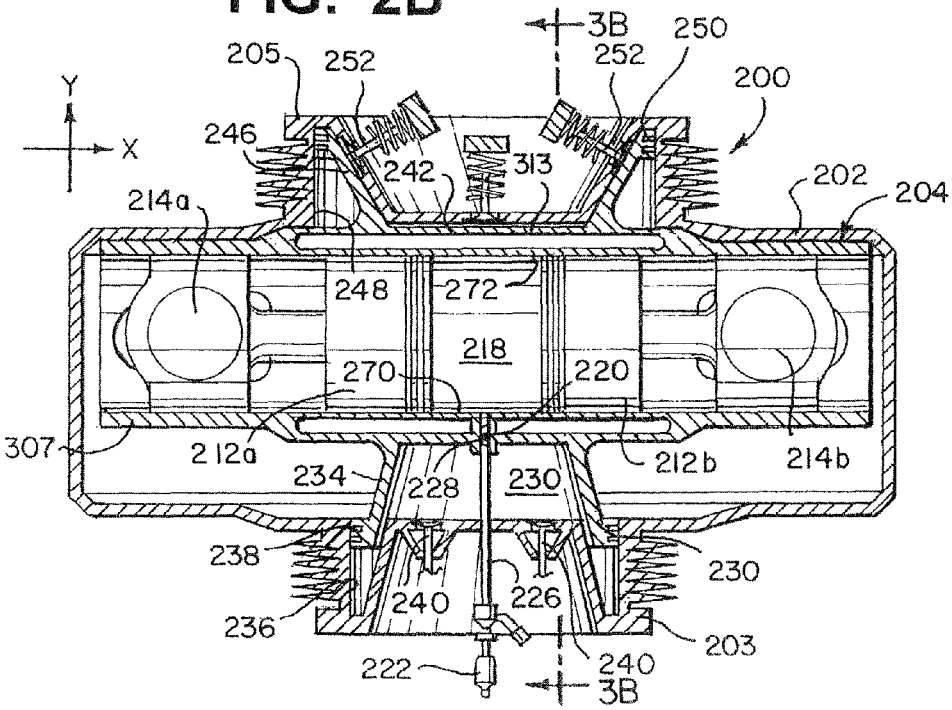

FIG. 2B shows the low pressure piston 204 at the upper end of its stroke inside the engine casing 202. With the low pressure piston 204 in this position, the high pressure pistons 212*a*, 212*b* have traveled about halfway between top dead center (FIG. 2A) and bottom dead center (FIG. 2D). Between FIG. 2A and FIG. 2B, the crankshafts 214*a*, 214*b* have rotated about their respective axes approximately 90 degrees.

In FIG. 2B, the engine's intake valves 240 and exhaust valves 252 are in a closed position. In some implementations, the engine's intake and exhaust valves 240, 252 close at about the same time that the low pressure piston 204 reaches the end of its stroke closest to the exhaust valves 252.

Figure 3B:
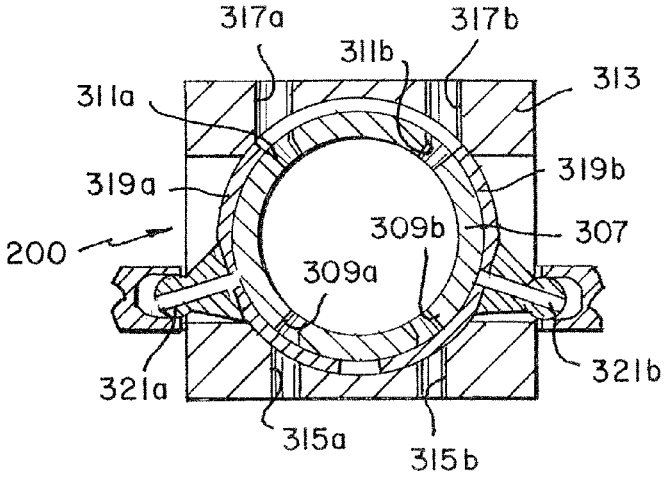

FIG. 3B shows a partial cross-sectional view of the engine 200 in FIG. 2B. As shown in FIG. 3B, each shutter 319*a*, 319*b* is positioned so that it substantially blocks fluid flow through the air path into the combustion chamber, but does not block the exhaust path out of the combustion chamber.

As the low pressure piston 204 moves between its position shown in FIG. 2A and its position shown in FIG. 2B, the sliding portion 226 of the fuel injector 222, which remains stationary relative to the engine casing 202, slides inside the passage 220. In FIG. 2B, the low pressure piston 204 is positioned relative to the fuel injector 222 so that only a small far portion of the fuel injector's sliding portion 226 passes into the passage 220. The fuel injection nozzle 228 at the upper far end of the fuel injector 222 is substantially outside of chamber 218.

In a typical implementation, with the low pressure piston 204 positioned as shown in FIG. 2B, a seal is maintained around the sliding portion 226 of the fuel injector 222 to prevent or substantially minimize leakage of combustion gases through the passage 220.

Due at least in part to the momentum of the engine's components, the high pressure pistons 212*a*, 212*b* in FIG. 2B continue to move apart and the crankshafts 214*a*, 214*b* continue to rotate. Moreover, from its position shown in FIG. 2B, the low pressure piston continues moving downward inside the engine casing 202.

The combustion chamber exhaust paths (formed, for example, by 311*a*, 311*b* and 317*a*, 317*b*) remains at least partially unblocked until the low pressure piston reaches approximately a middle position in its stroke (e.g., as shown in FIG. 2D). There is a low pressure environment (relative to the combustion chamber) created in the engine's exhaust/expansion chamber by virtue of the low pressure cylinder moving in a downward direction from its position in FIG. 2B to its position in FIG. 2D. This low pressure environment helps draw exhaust gases out of the combustion chamber.

Figure 2C:
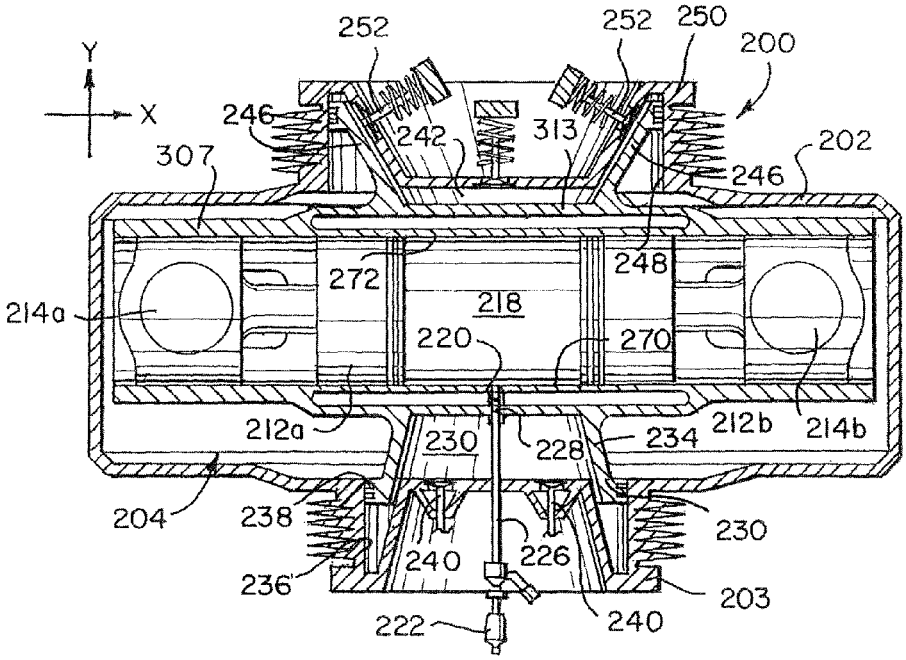
Figure 2D:
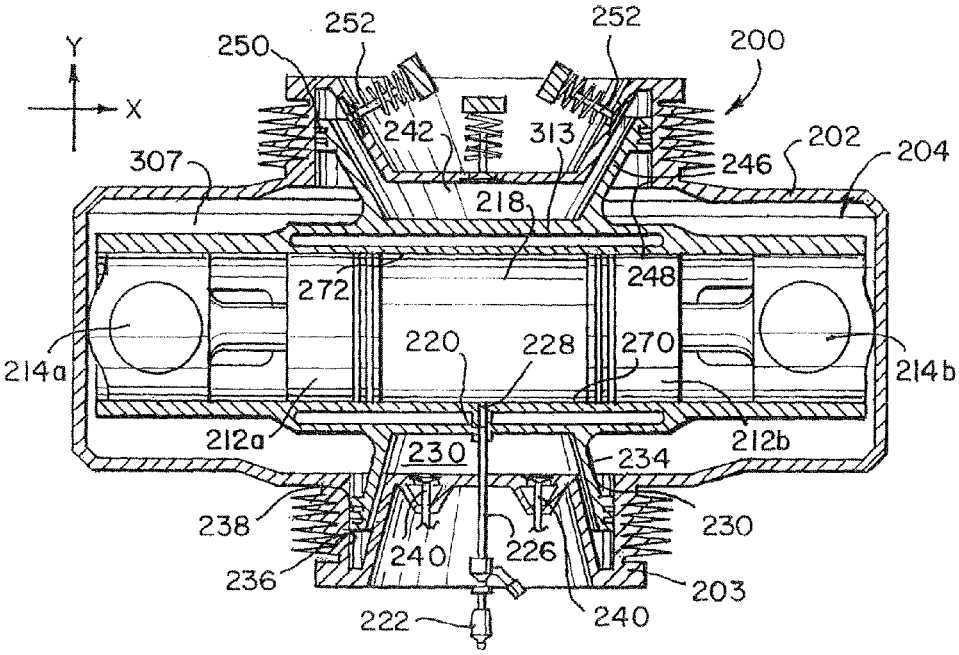

FIG. 2C shows the engine components in a configuration that corresponds to the crankshafts 214*a*, 214*b* being displaced approximately 135 degrees from their positions shown in FIG. 2A when the high pressure pistons 212*a*, 212*b* were at top dead center.

In the illustrated configuration, the combustion gases inside the combustion chamber 218 are continuing to expand and the high pressure pistons 212*a*, 212*b* are continuing to move apart. The low pressure piston 204 is continuing to move downward.

When the low pressure piston moves toward the position shown in FIG. 2D, the engine air intake valves 240 and the combustion chamber's air-intake valves 270 are in a closed position. Accordingly, the downward motion of the low pressure piston 204 is compressing the air inside the air-intake/pre-compression chamber 230.

The engine's exhaust valves 252 are in a closed position as well. The combustion chamber's exhaust valves 272 are open—at least until the low pressure piston reaches about midpoint in its stroke, which enables the combustion gases to flow from the combustion chamber 218 to the exhaust/expansion chamber 242. Typically, the combustion gases still are expanding as this occurs. The continued expansion of combustion gases into the exhaust/expansion chamber 242, in some implementations, helps urge the low pressure piston 204 to move downward inside the engine casing 202. In some implementations, this enhances the engine's efficiency.

In FIG. 2C, the sliding portion 226 of the fuel injector 222, which is stationary relative to the engine casing 202, is sliding through passage 220 toward the combustion chamber 218.

FIG. 2D shows the engine components in a configuration that corresponds to the crankshafts 214*a*, 214*b* being displaced approximately 180 degrees from their positions shown in FIG. 2A when the high pressure pistons 212*a*, 212*b* were at top dead center. Accordingly, the high pressure pistons 212*a*, 212*b* in FIG. 2D are at bottom dead center.

The low pressure piston is continuing to move in a downward direction. In some implementations, at the point in the cycle shown in FIG. 2D, the combustion gases are continuing to expand in the exhaust/expansion chamber 242, which contributes to pushing the low pressure piston down in the engine casing 202.

In a typical implementation, when the low pressure piston is in the position shown in FIG. 2D, the engine air intake valves 240 and the combustion chamber's air-intake paths are blocked by shutters (as shown in FIG. 3A, for example) and so, the downward motion of the low pressure piston 204 continues to compress the air inside the air-intake/pre-compression chamber 230.

Moreover, in a typical implementation, when the low pressure piston is in the position shown in FIG. 2D, the engine's exhaust valves 252 are in a closed position and the combustion chamber's exhaust paths are blocked by shutters (as shown in FIG. 3A, for example).

In FIG. 2C, the sliding portion 226 of the fuel injector 222, which is stationary relative to the engine casing 202, continues sliding through passage 220 into the combustion chamber 218.

Figure 2E:
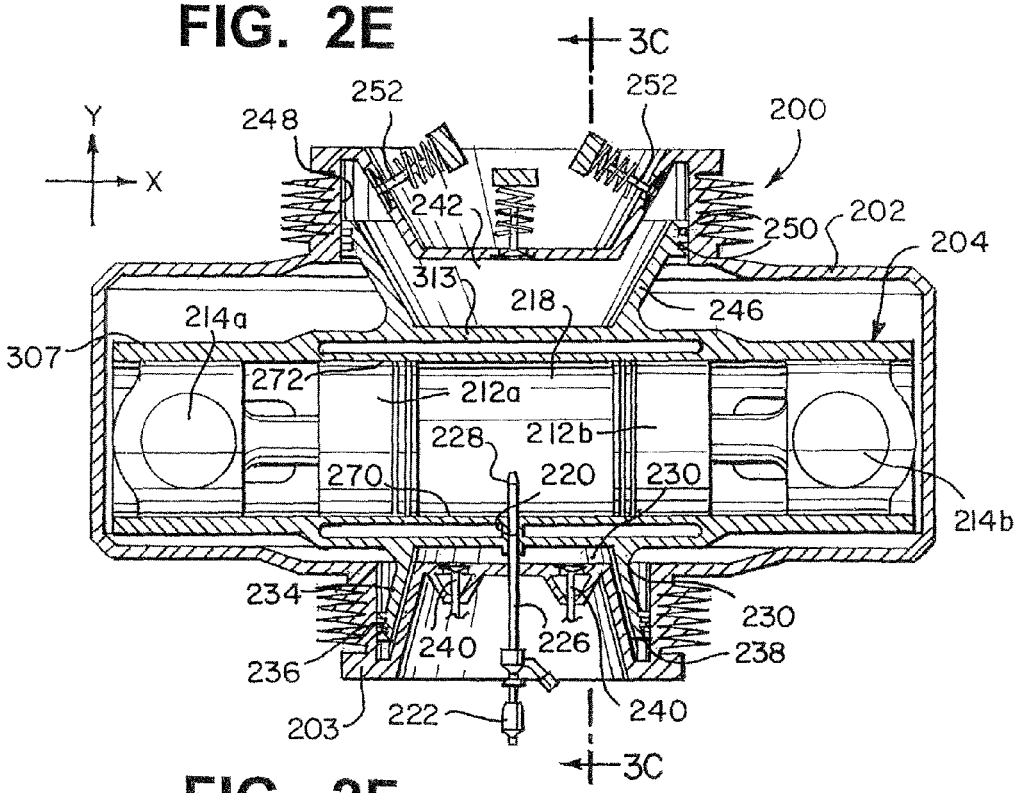

FIG. 2E shows the engine components in a configuration that corresponds to the crankshafts 214*a*, 214*b* being displaced approximately 225 degrees from their positions shown in FIG. 2A when the high pressure pistons 212*a*, 212*b* were at top dead center.

In FIG. 2E, the low pressure piston is continuing to move in a downward direction. The engine air intake valves 240 and exhaust valves 252 are in a closed position.

Figure 3C:
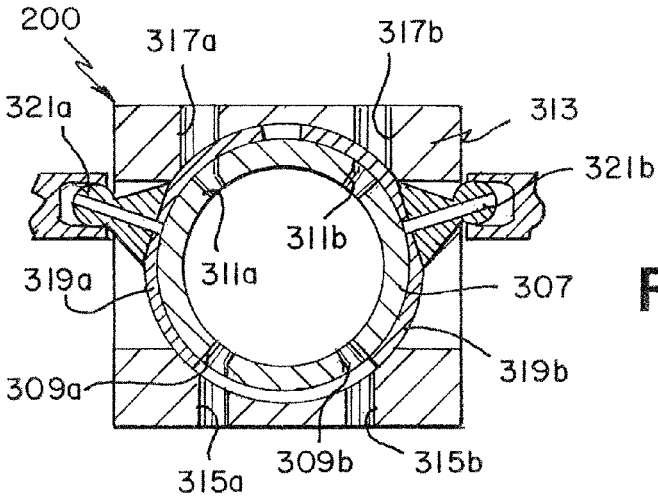

FIG. 3C shows a partial cross-sectional view of the engine 200 in FIG. 2E. As shown in FIG. 3C, each shutter 319*a*, 319*b* is positioned so that it substantially blocks fluid flow through an exhaust path, but does not block the air path into the combustion chamber.

Figure 2F:
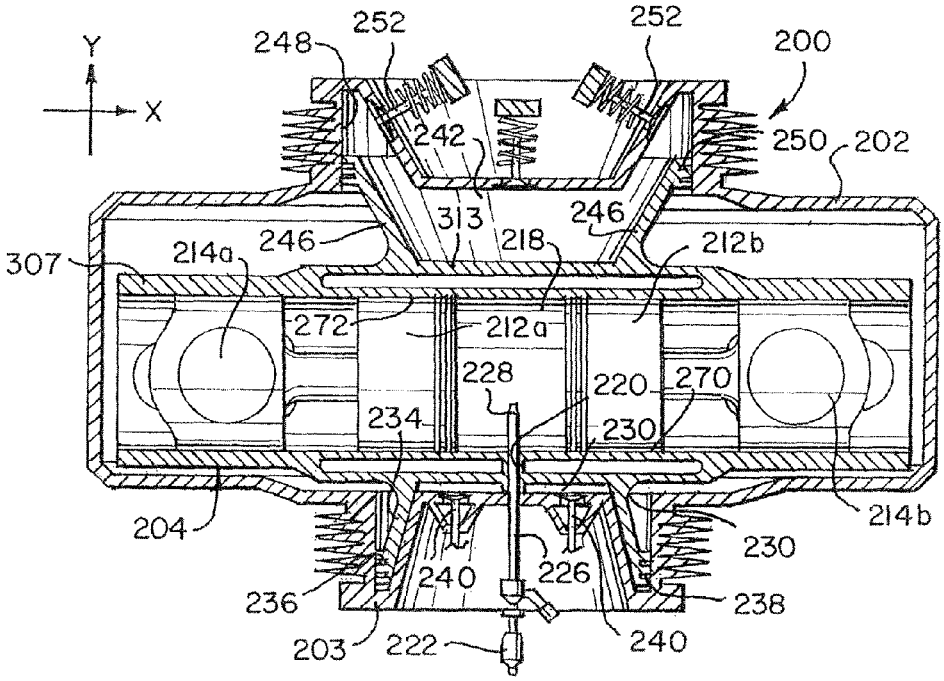

As the low pressure piston moves from its position in FIG. 2D to its position in FIG. 2F, the combustion chamber's air-intake path, which includes 315*a* and 309*a*, for example, becomes unblocked by a shutter thereby enabling the compressed air inside the air-intake/pre-compression chamber 230 to begin to flow into the combustion chamber. The pressure of the compressed air, as well as the continuing downward motion of the low pressure piston 204 typically results in a large amount of air being pushed into the combustion chamber 218 during this portion of the engine's operating cycle. In general, as the combustion chamber's air-intake path becomes unblocked, the combustion chamber's exhaust path becomes blocked.

In FIG. 2E, the engine's high pressure pistons 212*a*, 212*b* are moving toward one another. In a typical implementation, with the engine components moving from their configuration in FIG. 2D to their configuration shown in FIG. 2F, the space between the two high pressure pistons 212*a*, 212*b* and the air-intake/pre-compression chamber 230 has a volume that is decreasing. As the volume decreases, the air moving from the air-intake/pre-compression chamber 230 into the combustion chamber 218 is further compressed.

Moreover, in FIG. 2E, the sliding portion 226 of the fuel injector 222, continues sliding through passage 220 deeper into the combustion chamber 218. The engine's exhaust valves 252 and the combustion chamber's exhaust valves 272 are in a closed position.

FIG. 2F shows the engine components in a configuration that corresponds to the crankshafts 214*a*, 214*b* being displaced approximately 270 degrees from their positions shown in FIG. 2A when the high pressure pistons 212*a*, 212*b* were at top dead center. The low pressure piston 204 is at the lowest point in its stroke. The high pressure pistons 212*a*, 212*b* are moving toward one another and are about midway between bottom dead center (FIG. 2D) and top dead center (FIG. 2A). As shown, the sliding portion 226 of the fuel injector 222 is extended into the combustion chamber 218 as deep as it will be.

In FIG. 2F, substantially all of the air from the air-intake/pre-compression chamber 230 has been transferred into the combustion chamber 218. The combustion chamber exhaust path is blocked by a shutter. The continued movement of the high pressure pistons 212*a*, 212*b* toward one another from their respective positions in FIG. 2F further compresses the air inside the combustion chamber 218. The engine air intake valves 240 are in a closed position. The engine's exhaust valves 252 are in a closed position. In a typical implementation, with the engine components configured as shown, the combustion gases have substantially finished being compressed.

Typically, fuel injection occurs when the low pressure piston is somewhere between where it is shown in FIGS. 2D and 2F. In some implementations, fuel injection occurs right at FIG. 2D. In a typical implementation, heat of compression triggers combustion.

Figure 4:
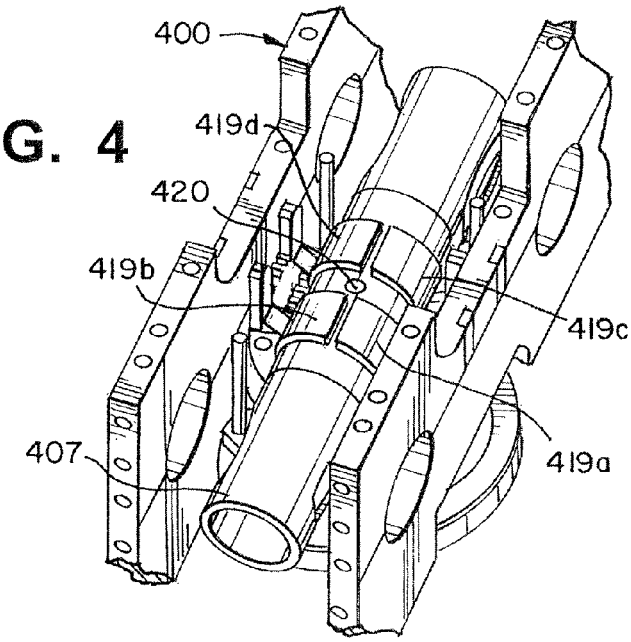
FIG. 4 is a partial cut-away perspective view showing an implementation of an engine.

FIG. 4 shows a partial perspective view of an engine 400 similar to the engine 100 shown in FIGS. 1A and 1B, looking up from the bottom of the engine.

As shown, the engine 400 has a total of four separate shutters 419*a*, 419*b*, 419*c* and 419*d*. Each shutter 419*a*, 419*b*, 419*c* and 419*d* is curved to follow the contour of the outer surface of the wall 407, which, in the illustrated implementation, is substantially annular. Moreover, each shutter 419*a*, 419*b*, 419*c* and 419*d* is contoured so that it can maintain close contact with that outer surface as the shutter moves in a circumferential direction around the wall 407.

In the illustrated figure, each shutter 419*a*, 419*b*, 419*c* and 419*d* is positioned to cover a corresponding one of four combustion chamber intake ports (not visible in FIG. 4).

A passage 420 is provided in the wall 407, to accommodate a fuel injector (not shown) passing through the wall 407 and into the engine's combustion chamber.

Figure 5:
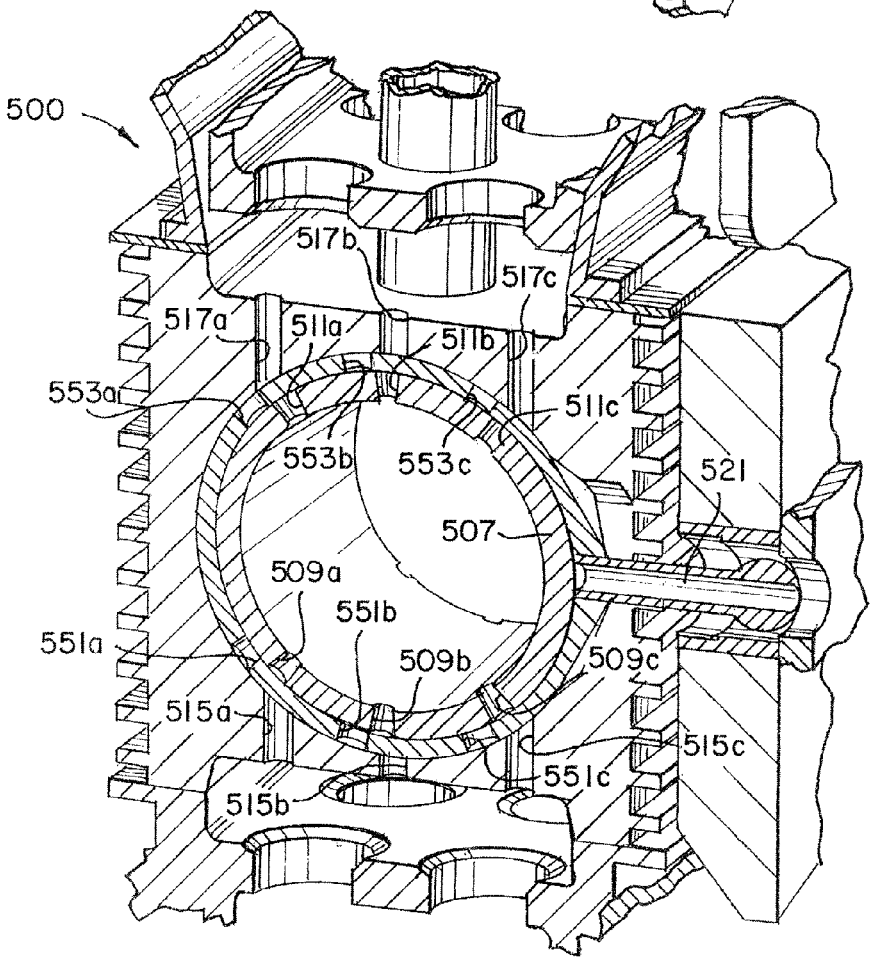
FIG. 5 is a partial cutaway view showing an implementation of an engine.

FIG. 5 is a partial cutaway view showing an engine 500 that is similar to the engine 100 in FIGS. 1A and 1B, discussed above.

However, the shutter 519 in the engine 500 in FIG. 5 extends around an entire perimeter of the cylindrical wall 507 that contains the high pressure pistons (not shown in FIG. 5).

Additionally, there are more fluid flow passages into and out of the combustion chamber in the engine 500 in FIG. 5 than there are in the engine 100 in FIGS. 1A and 1B. More particularly, the engine 500 in FIG. 5 has three combustion chamber intake ports 509*a*, 509*b* and 509*c* in wall 507, three intake passages 515*a*, 515*b* and 515*c* in block 513 and three intake transfer passages 551*a*, 551*b* and 551*c* formed in the shutter 519. Additionally, the engine 500 in FIG. 5 has three combustion chamber exhaust ports 511*a*, 511*b*, 511*c* in wall 507, three exhaust passages 517*a*, 517*b* and 517*c* in block 513 and three exhaust transfer passages 553*a*, 553*b* and 553 formed in the shutter 519.

The shutter 519 in FIG. 5 is configured such that the intake transfer passages 551*a*, 551*b* and 551*c* are angularly offset from the combustion chamber intake ports 509*a*, 509*b* and 509*c* in wall 507 and from the intake passages 515*a*, 515*b* and 515*c* in block 513. Therefore, as illustrated, the shutter 519 is positioned to prevent fluid flow into the combustion chamber through the combustion chamber intake ports 509*a*, 509*b* and 509*c* in wall 507 and the intake passages 515*a*, 515*b* and 515*c* in block 513.

The intake transfer passages 551*a*, 551*b* and 551*c* are distributed about the shutter 519 in such a way that, if the shutter 519 is rotated about the outer perimeter of wall 507, then the intake transfer passages 551*a*, 551*b* and 551*c* can align with the combustion chamber intake ports 509*a*, 509*b* and 509*c*, respectively, and the intake passages 515*a*, 515*b* and 515*c*, respectively, thereby establishing a fluid flow path for air into the combustion chamber.

The shutter 519 in FIG. 5 is also configured such that the exhaust transfer passages 553*a*, 553*b* and 553*c* are angularly offset from the combustion chamber exhaust ports 511*a*, 511*b*, 511*c* in wall 507 and from the exhaust passages 517*a*, 517*b* and 517*c* in block 513. Therefore, as illustrated, the shutter 519 is positioned to prevent fluid flow out of the combustion chamber through the combustion chamber exhaust ports 511*a*, 511*b*, 511*c* in wall 507 and the exhaust passages 517*a*, 517*b* and 517*c* in block 513.

The exhaust transfer passages 553*a*, 553*b* and 553*c* are distributed about the shutter 519 in such a way that, if the shutter 519 is rotated about the outer perimeter of wall 507, then the exhaust transfer passages 553*a*, 553*b* and 553*c* can align with the combustion chamber exhaust ports 511*a*, 511*b*, 511*c*, respectively, and with the exhaust passages 517*a*, 517*b* and 517*c*, respectively, thereby opening a fluid flow path for combustion gases to exit the combustion chamber.

In the illustrated implementation, the shutters 519 is arranged so as to move circumferentially around the wall 507 to various positions. The shutter 519 has an actuator 521 that is similar to the shutters 119*a*, 119*b* in engine 100, and facilitates moving the shutter 519 between the various positions as the low pressure piston reciprocates in the vertical direction.

More particularly, in a typical implementation, the actuator 521 is rigidly coupled to an outer surface of the shutter 519, extends outward from that outer surface, extends through a slot or opening in block 513 and terminates at a ball joint 525 at a distal end of the actuator. In the illustrated implementation, the ball joint 525 allows the actuator 519 to rotate freely about the joint housing and to translate into or out of the joint housing a small amount.

Figure 6A:
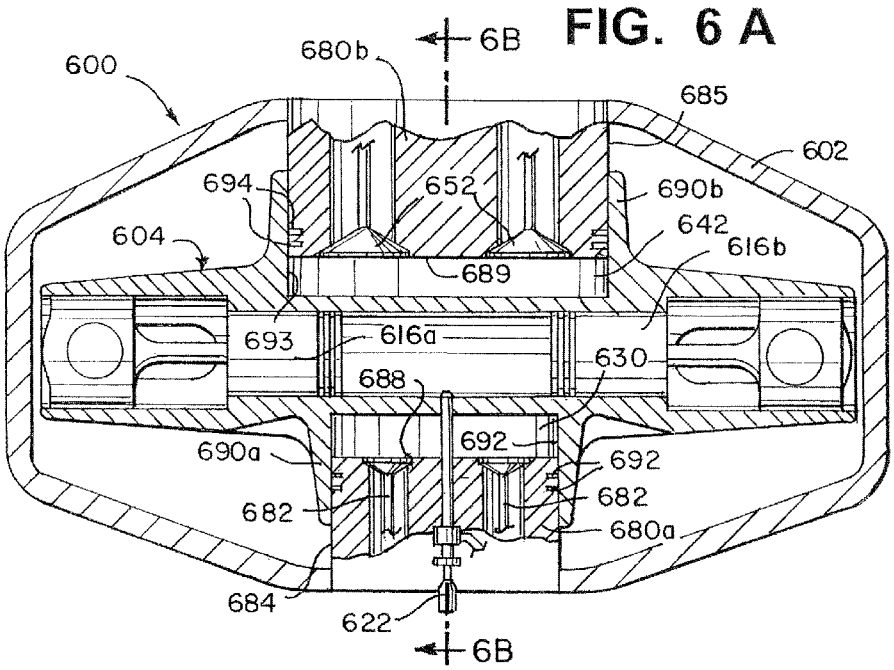
FIG. 6A is a partial, cross-sectional side view showing an implementation of an engine.
Figure 6B:
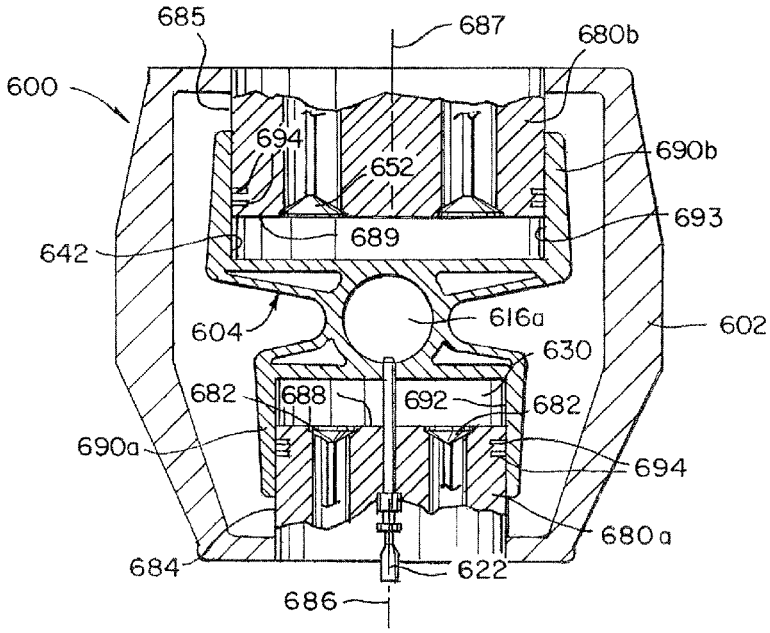
FIG. 6B is a partial cross-sectional view of the engine in FIG. 6A taken along line 6B-6B.

FIG. 6A is a partial, cross-sectional, side view of an engine 600 that is similar to the other engines disclosed herein, subject certain exceptions. FIG. 6B is a partial cross-sectional view of the engine 600 taken along line 6B-6B in FIG. 6A.

The engine casing 602 in the engine 600 has two substantially cylindrical extensions 680*a*, 680*b* (also referred to as "body portions"), each of which extends from an inner surface of the engine casing 602 toward the low pressure piston assembly 604. The extensions 680*a*, 680*b* can be integrally formed with the engine casing 602 or otherwise coupled to the engine casing 602. In the illustrated implementation, the first substantially cylindrical extension 680*a* has surfaces that define a portion of an air intake path for the engine 600. In addition, the first substantially cylindrical extension 680*a* houses intake valves 682 that are configured to control fluid flow through the air intake path. In the illustrated implementation, each intake valve 682 has a plug portion arranged to seal against a valve seat formed in a distal (inner most) surface 688 of the first substantially cylindrical extension 680*a*. The first substantially cylindrical extension 680*a* has an outer surface 684 that is substantially cylindrical and has a longitudinal axis 686 that is perpendicular to the distal (inner most) surface 688 of the first substantially cylindrical extension 680*a*.

The illustrated low pressure piston assembly 604 is configured so as to reciprocate relative to the first substantially cylindrical extension 680*a* and to accommodate a pair of second piston assemblies 616*a*, 616*b* that reciprocate inside and relative to the low pressure piston assembly 604.

According to the illustrated implementation, the low pressure piston assembly 604 has a first extension portion 690*a* with a substantially cylindrical inner surface 692 that defines a space to accommodate the first substantially cylindrical extension 680*a*, which extends into the space with little to no annular space therebetween. A portion of the first extension portion 690*a* surrounds a portion of the first substantially cylindrical extension 680*a*. When the engine 600 is operating, the first extension portion 690*a* moves up and down relative to the first substantially cylindrical extension 680*a* as the first piston assembly reciprocates.

There are two circumferential grooves 694 (the number of grooves can vary) formed in the outer surface 684 of the first substantially cylindrical extension 680*a* near a distal end thereof. In a typical implementation, each circumferential groove 694 at least partially contains and supports a sealing element (e.g., a piston ring, o-ring, or the like), which is not shown in the figures. The sealing element, therefore, sits between the first substantially cylindrical extension 680*a* and the first extension portion 690*a* of the low pressure piston assembly 604 and seals the engine's air intake/pre-compression chamber 630.

In a typical implementation, the sealing element is configured so that during engine operation, the sealing element remains substantially stationary along the longitudinal axis 686 relative to the first substantially cylindrical extension 680*a* and seats against the substantially cylindrical inner surface 692 of the reciprocating first extension portion 690*a*. In a typical implementation, throughout the engine operating cycle, some portion of the substantially cylindrical inner surface 692 of the first extension portion 690 is in contact with or at least very close to an outer surface of the sealing member.

In the illustrated implementation, the first substantially cylindrical extension 680*a*, the first extension portion 690*a* of the low pressure piston assembly 604, the sealing elements and the intake valves 682 cooperate to define an air intake/pre-compression chamber 630 for the engine 600. During engine operation, the volume in the air intake/pre-compression chamber 630 changes as the low pressure piston assembly 604 reciprocates relative to the first substantially cylindrical extension 680*a*.

The second substantially cylindrical extension 680*b* in the illustrated engine 600 is located at a side of the low pressure piston assembly 604 opposite the first substantially cylindrical extension 680*a*. More particularly, in the illustrated implementation, the second substantially cylindrical extension 680*b* is located at an exhaust side of the low pressure piston assembly 604, whereas the first substantially cylindrical extension 680*a* is located at an intake side of the low pressure piston assembly 604.

The second substantially cylindrical extension 680*b* has surfaces that define a portion of an exhaust path for the engine 600. In addition, the second substantially cylindrical extension 680*b* houses exhaust valves 652 that are configured to control fluid flow through the exhaust path. In the illustrated implementation, each exhaust valve 652 has a plug portion arranged to seal against a valve seat formed in a distal (inner most) surface 689 of the second substantially cylindrical extension 680*b*. The second substantially cylindrical extension 680*b* has an outer surface 685 that is substantially cylindrical and has a longitudinal axis 687 that is perpendicular to the distal (inner most) surface 689 of the second substantially cylindrical extension 680*b*. In the illustrated implementation, the longitudinal axis 687 of the second substantially cylindrical extension 680*b* is aligned with the longitudinal axis 686 of the first substantially cylindrical extension 680*a*.

Since the second substantially cylindrical extension 680*b* is stationary with respect to the engine casing 602, the low pressure piston assembly 604 reciprocates relative to the second substantially cylindrical extension 680*b*.

According to the illustrated implementation, the low piston assembly 604 has a second extension portion 690*b* with a substantially cylindrical inner surface 692 that defines a space to accommodate the second substantially cylindrical extension 680*b*, which extends into the space with little to no annular space therebetween. A portion of the second extension portion 690*b* surrounds a portion of the second substantially cylindrical extension 680*b*. When the engine 600 is operating, the second extension portion 690*b* moves up and down relative to the second substantially cylindrical extension 680*b* as the low pressure piston assembly 604 reciprocates.

There are two circumferential grooves 694 (the number of grooves can vary) formed in the outer surface 685 of the second substantially cylindrical extension 680*b* near a distal end thereof. In a typical implementation, each circumferential groove 694 at least partially contains and supports a sealing element (e.g., a piston ring, o-ring, or the like), which is not shown in the figures. The sealing element, therefore, sits between the second substantially cylindrical extension 680*b* and the second extension portion 690*b* of the low pressure piston assembly 604 and seals the engine's exhaust/expansion chamber 642.

In a typical implementation, the sealing element is configured so that during engine operation, the sealing element remains substantially stationary along the longitudinal axis 686 relative to the second substantially cylindrical extension 680*b* and seats against the substantially cylindrical inner surface 693 of the reciprocating second extension portion 690*b*. In a typical implementation, throughout the engine operating cycle, some portion of the inner surface 693 of the second extension portion 690*b* is in contact with or at least very close to an outer surface of the sealing member.

In the illustrated implementation, the second substantially cylindrical extension 680*b*, the second extension portion 690*b* of the low pressure piston assembly 604, the sealing elements and the exhaust valves 652 cooperate to define an exhaust/expansion chamber 642 for the engine 600. During engine operation, the volume in the exhaust/expansion chamber 642 changes as the low pressure piston assembly 604 reciprocates relative to the second substantially cylindrical extension 680*b*.

In the illustrated implementation, the substantially cylindrical inner surface 693 of the second extension portion 690*b* defines an inner space that has a diameter that is greater than the corresponding diameter of the inner space defined by the substantially cylindrical surface 692 of the first extension portion 690*a*. In the illustrated implementation, the maximum volume of the exhaust/expansion chamber 642 is greater than the maximum volume of the air intake/pre-compression chamber 684. In a typical implementation, this arrangement results in an expansion ratio that is larger than the compression ratio, allowing the gas to expand, in some instances, all the way to atmospheric pressure, thus producing a large amount of work.

The illustrated engine 600 has surfaces that define a fuel injection passage 692 into the engine's combustion chamber. Additionally, a fuel injector 622, which is stationary relative to the engine casing 602, extends at least partially through the fuel injection passage 692. Moreover, the low pressure piston assembly 604 is arranged to move in a reciprocating manner relative to the fuel injector 622.

Figure 7:
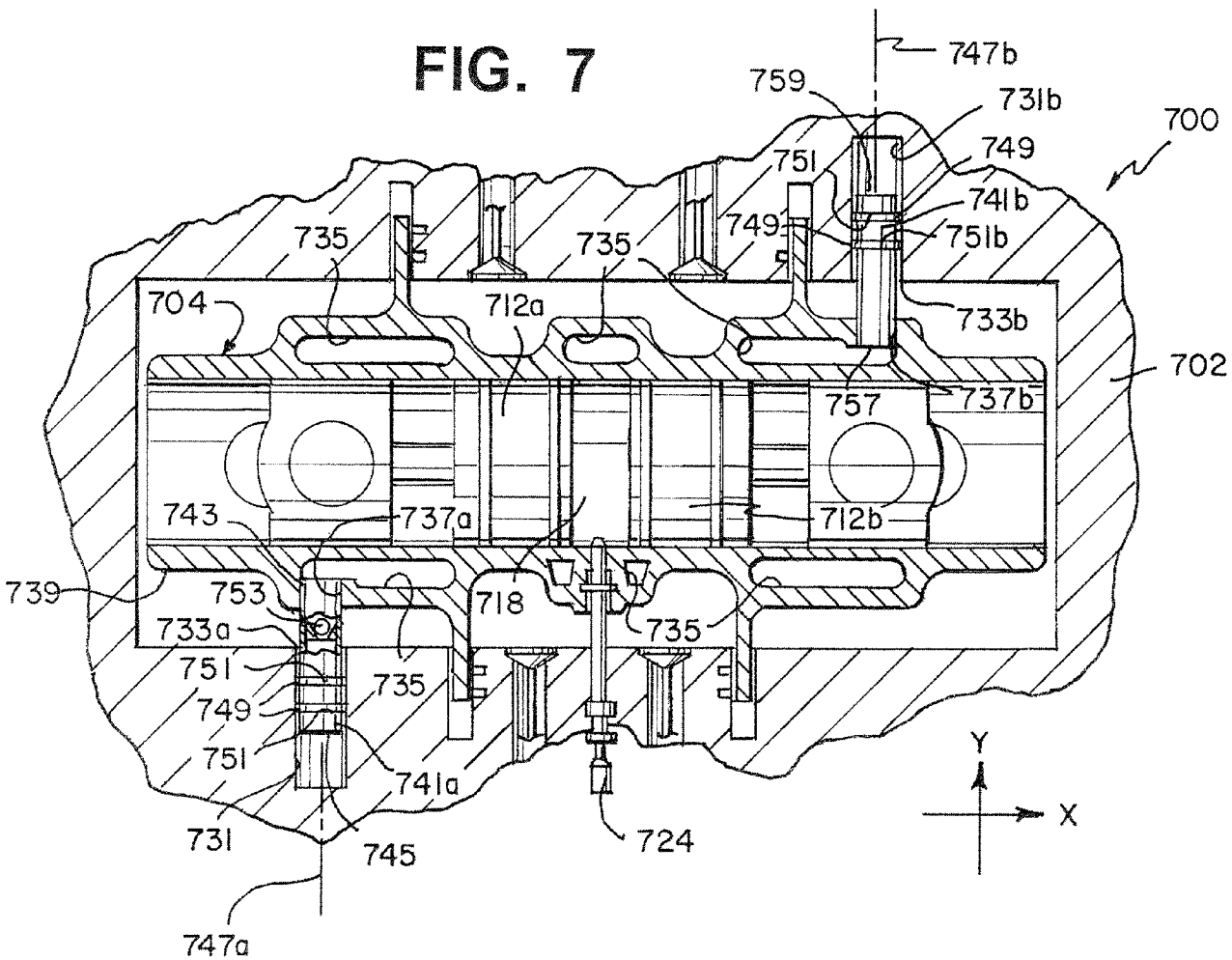
FIG. 7 is a partial cross-sectional side view showing an implementation of an engine.

FIG. 7 is a partial cross-sectional side view of an engine 700 that is in some respects similar to some of the other engines disclosed herein.

For example, the illustrated engine 700 has a low pressure piston assembly 704 with a pair of opposed high pressure piston assemblies 712*a*, 712*b* inside the low pressure piston assembly 704. A combustion chamber 718 is also inside the low pressure piston assembly 704 and between the two high pressure piston assemblies 712*a*, 712*b*. The low pressure piston assembly 704 is configured to reciprocate up-and-down (i.e., along the y-axis in FIG. 7) relative to the engine casing 702 when the engine 700 is operating. The high pressure piston assemblies 712*a*, 712*b* are configured to reciprocate side-to-side (i.e., along the x-axis in FIG. 7) relative to the engine casing 702 when the engine 700 is operating. The engine has a fuel injector 724 that is fixed with respect to the engine casing 702 and slides through an opening in the low pressure piston deeper and less deep into the combustion chamber 718 as the low pressure piston reciprocates.

FIG. 7 shows portions of a coolant system for delivering coolant at least to the reciprocating low pressure piston assembly 704 of the illustrated engine 700.

In particular, the illustrated engine casing 702 has surfaces that define a substantially tubular coolant inlet passage 731 with an open end 733*a* that opens into the space inside the engine casing. In a typical implementation, the engine 700 would be connected to (and, during operation would receive coolant from) an external source of coolant (e.g., water, radiator fluid, oil, etc.) adapted to provide a continuous supply of coolant to the coolant inlet passage 731.

The first piston assembly 704 has surfaces that define a piston coolant jacket 735 inside the first piston assembly. In the illustrated implementation, the piston coolant jacket 735 includes a number of passages that are fluidly connected to each other and extend throughout various portions of the low pressure piston assembly 704. A variety of arrangements are possible for the piston coolant jacket 735. However, typically, the piston coolant jacket 735 is arranged so that coolant will flow throughout the low pressure piston assembly 704 when the engine is operating.

The piston coolant jacket 735 has a first opening 737*a* exposed at an outer surface 739 of the first piston assembly 704. In the illustrated implementation, the first opening 737*a* allows for coolant to flow into the piston coolant jacket 735 of the low pressure piston assembly 704.

A first fluid communication conduit 741*a* extends between the open end 733*a* of the coolant inlet passage 731 in the engine casing 702 and the first opening 737*a* and is configured so that it can deliver coolant from the coolant inlet passage 731 to the piston coolant jacket 735. The illustrated first fluid communication conduit 741*a* is a short length of hollow tube.

In the illustrated implementation, the first fluid communication conduit 741*a* has a first end 743 that is rigidly coupled (e.g., adhered, soldered, welded, screwed into, integrally molded, or the like) to the first opening 737*a* in the piston coolant jacket 735. More particularly, the outer, substantially cylindrical surface of the first fluid communication conduit 741*a* is rigidly coupled to the inner, substantially cylindrical surface of the first opening 737*a* in the piston jacket 735.

In the illustrated implementation, the first fluid communication conduit 741*a* has a second end 745 that extends through the open end 733*a* of the coolant inlet passage 731 and into the coolant inlet passage 731. The second end 745 of the first fluid communication conduit 741*a* is not rigidly coupled to the open end 733*a* of the coolant inlet passage 731 and, therefore, is able to slide up-and-down (i.e., along the y-axis in FIG. 7) within and relative to the coolant inlet passage 731. More particularly, the first fluid communication conduit moves in a reciprocating manner inside coolant inlet passage 731 as the first piston assembly 704 reciprocates relative to the engine casing 702.

According to the illustrated implementation, the first fluid communication conduit 741*a* has an outer surface that is substantially tubular and defines a first longitudinal axis 747*a*, which extends in the direction defined by the y-axis in FIG. 7. The first fluid communication conduit 741*a* extends through the open end 733*a* of the coolant inlet passage 731 and into the coolant inlet passage 731 in a direction along its longitudinal axis 747*a*.

A pair of sealing elements 749 (e.g., O-rings, piston rings, or the like) is disposed between an outer surface of the first fluid communication conduit 741*a* and an inner surface of the coolant inlet passage 731. A typical implementation will include at least one sealing element 749 and certain implementations will include more than two sealing elements 749.

In a typical implementation, each sealing element 749 has a substantially annular shape and may extend, for example, around an entire periphery of the first fluid communication conduit 741*a* or around a substantial portion (but not all) of the first fluid communication channel 741*a*. In general, the arrangement of sealing elements 749 between the first fluid communication conduit 741*a* and the coolant inlet passage helps prevent coolant, intake air or other gases from leaking past the interface between the stationary fluid inlet passage 731 and the reciprocating first fluid communication conduit 741*a*.

Each of the sealing elements 749 around the first fluid communication conduit 741*a* is configured so as to move up-and-down (i.e., along the y-axis in FIG. 7) with first fluid communication conduit 741*a* as the low pressure piston assembly 704 reciprocates relative to the engine casing 702. Moreover, each sealing element 749 around the first fluid communication conduit 741*a* slides against the inner surface of the coolant inlet passage 731 as the low pressure piston assembly 704 reciprocates relative to the engine casing 702.

There are two grooves 751 formed in the outer surface of the first fluid communication conduit 741*a*. Typically, each groove 751 extends about an entire periphery of the outer surface of the first fluid communication conduit 741*a*. Each groove 751 supports one of the sealing elements 749. In general, there will be at least one groove and sealing element, but, in some instances, there may be more than two grooves and sealing elements. The number of sealing elements generally matches the number of grooves.

In the illustrated implementation, there is a check valve 753 disposed inside the first fluid communication conduit 741*a*. In some implementations, the check valve 753 may be disposed in other areas of the fluid communication channel formed in the reciprocating parts of the illustrated engine (e.g., in the piston coolant jacket 735 or the second fluid communication conduit 755). In general, the check valve 753 is operable to allow fluid to flow through the check valve 753 in only one direction. For example, in the illustrated implementation, the check valve 753 is operable to allow fluid to flow only in the direction from the coolant inlet passage 731 toward the piston coolant jacket 735.

In the illustrated implementation and in general, the check valve 753 is configured in such a manner that the reciprocating motion of the first piston assembly 704 relative to the engine casing 702 causes changes in coolant pressure across the check valve 753. These changes cause the check valve 753 to open and close on a periodic basis as the first piston assembly 704 reciprocates relative to the engine casing 702. The periodic opening and closing of the check valve 753 as the first piston assembly 704 reciprocates creates a pumping effect that facilitates moving coolant through the first fluid communication conduit 741*a*, the piston coolant jacket 735 and other portions of the engine's coolant circuit, which may include, for example, an external radiator/heat exchanger and related piping.

The illustrated piston coolant jacket 735 has a second opening 737*b* at an opposite side of the low pressure piston assembly 704 from the first opening 737*a*. More particularly, the second opening 737*b* is at an upper surface of the low pressure piston assembly 704 and opens in an upward direction, whereas the first opening 737*a* is at a lower surface of the low pressure piston assembly 704 and opens in a downward direction. In the illustrated implementation, the second opening 737*b* allows for coolant to flow out of the piston coolant jacket 735 of the low pressure piston assembly 704.

The engine casing 702 has surfaces that define a coolant outlet passage 731*b* with an open end 733*b*. A second fluid communication conduit 741*b* extends between the open end 733*b* of the coolant outlet passage 731*b* in the engine casing 702 and the second opening 737*b* and is configured so that it can deliver coolant from the piston coolant jacket 735 to the coolant outlet passage 731*b*. The illustrated second fluid communication conduit 741*b* is a short length of hollow tube.

In the illustrated implementation, the second fluid communication conduit 741*b* has a first end 757 that is rigidly coupled (e.g., adhered, soldered, welded, screwed into, integrally molded, or the like) to the second opening 737*b* in the piston coolant jacket 735. More particularly, the outer, substantially cylindrical surface of the second fluid communication conduit 741*b* is rigidly coupled to the inner, substantially cylindrical surface of the second opening 737*b* in the piston jacket 735.

In the illustrated implementation, the second fluid communication conduit 741*b* has a second end 759 that extends through the open end 733*b* of the coolant outlet passage 731 and into the coolant outlet passage 731. The second end 759 of the second fluid communication conduit 741*b* is not rigidly coupled to the open end 733*b* of the coolant outlet passage 731*b* and, therefore, is able to slide in an up-and-down manner (i.e., along the y-axis in FIG. 7) inside and relative to the coolant outlet passage 731*b*. More particularly, the second fluid communication conduit 741*b* moves in a reciprocating manner inside coolant outlet passage 731 as the first piston assembly 704 reciprocates relative to the engine casing 702.

According to the illustrated implementation, the second fluid communication conduit 741*b* has an outer surface that is substantially tubular and defines a second longitudinal axis 747*b*, which extends in the direction defined by the y-axis in FIG. 7. The second fluid communication conduit 741*b* extends through the open end 733*b* of the coolant outlet passage 731*b* and into the coolant inlet passage 731 in a direction along its longitudinal axis 747*b*.

A pair of sealing elements 749 (e.g., O-rings, piston rings, or the like) is disposed between an outer surface of the second fluid communication conduit 741*b* and an inner surface of the coolant inlet passage 731*b*. A typical implementation will include at least one sealing element 749 and certain implementations will include more than two sealing elements 749.

In a typical implementation, each sealing element 749 has a substantially annular shape and may extend, for example, around an entire periphery of the second fluid communication conduit 741*b* or around a substantial portion (but not all) of the second fluid communication channel 741*b*. In general, the arrangement of sealing elements 749 between the second fluid communication conduit 741*b* and the coolant outlet passage 731*b* helps prevent coolant, exhaust gas or other gases from leaking past the interface between the stationary fluid outlet passage 731*b* and the reciprocating second fluid communication conduit 741*b*.

Each sealing element 749 around the second fluid communication conduit 741*b* is configured so as to move up-and-down (i.e., along the y-axis in FIG. 7) with second fluid communication conduit 741*b* as the low pressure piston assembly 704 reciprocates relative to the engine casing 702. Moreover, each sealing elements 749 around the second fluid communication conduit 741*b* slides against the inner surface of the coolant inlet passage 731 as the low pressure piston assembly 704 reciprocates relative to the engine casing 702.

There are two grooves 751 formed in the outer surface of the second fluid communication conduit 741*b*. Typically, each groove 751 extends about an entire periphery of the outer surface of the second fluid communication conduit 741*b*. Each groove 751 supports one of the sealing elements 749 that are disposed around the second fluid communication conduit 741*b*. In general, there will be at least one groove and sealing element, but, in some instances, there may be more than two grooves and sealing elements. The number of sealing elements generally matches the number of grooves.

In the illustrated implementation, the second opening 737*b* in the piston coolant jacket 735 is at a side of the first piston assembly 704 opposite the first opening 737*a* in the piston coolant jacket 735 relative to an axis (i.e., the y-axis in FIG. 7) on which the first piston assembly 704 reciprocates when the engine 700 is operating. Moreover, the open end 733*a* of the coolant inlet passage 731*a* opens toward the first piston assembly 704 and the first fluid communication conduit 741*a* is a substantially straight tube. Likewise, the open end 733*b* of the coolant outlet passage 731*b* opens toward the first piston assembly 704 and the second fluid communication conduit 741*b* is a substantially straight tube.

Figure 8:
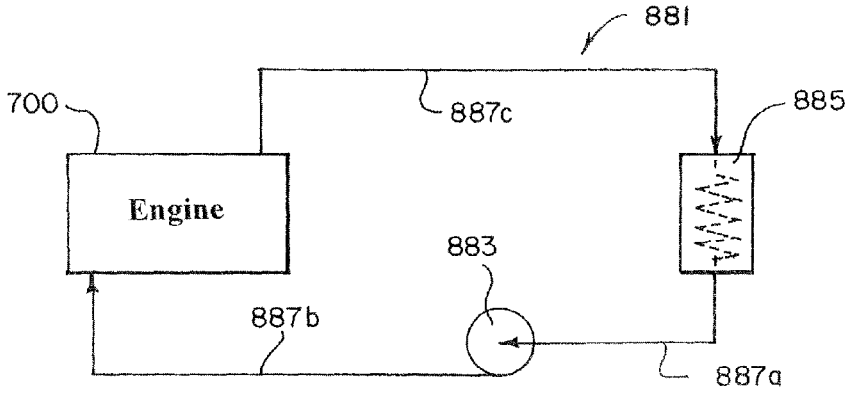
FIG. 8 is a schematic block diagram showing an implementation of an engine cooling system.

FIG. 8 shows a schematic diagram of that includes the components of a cooling system 881 for engine 700 external to the engine 700.

The illustrated system 881 includes an (optional) coolant pump 883 configured to pump coolant through the system 881. In general, if an engine includes or is coupled to a coolant pump, then the check valve 753 may be excluded. Similarly, in general, if an engine includes a check valve, then a separate coolant pump may be excluded. In a typical implementation, the coolant pump is a centrifugal pump.

The illustrated system also includes a heat exchanger 885. In some implementations, the heat exchanger 885 is a radiator. However, the heat exchanger 885 can be virtually any type of heat exchanger. There is a first fluid communication channel 887*a*, 887*b* configured to carry coolant from the heat exchanger to the engine (e.g., to the engine's coolant inlet passage) and a second fluid communication channel 887*c* configured to carry fluid from the engine (e.g., from the engine's coolant outlet passage) to the heat exchanger 885 and the coolant outlet passage 731*b*.

A number of implementations of the invention have been described. Nevertheless, it will be understood that various modifications may be made without departing from the spirit and scope of the invention.

For example, the specific arrangement and configuration of various engine components can vary. Indeed, in some implementations, certain components may be dispensed with entirely. For example, some implementations can include only one (i.e., not two) high pressure piston arranged for reciprocal motion inside a low pressure piston.

Moreover, the relative arrangement and direction of movement that the various components experience during engine operation can vary as well. So, for example, in some implementations, rather than moving up and down, the low pressure piston may be adapted to move left to right. In such instances, the high pressure pistons may be adapted to move up and down inside the low pressure piston.

The various components disclosed can have a variety of shapes and sizes. For example, the size, shape, number and relative arrangement of ports, passages, etc. for fluid flow throughout the engine can vary considerably. Additionally, the specific arrangement of the actuator assembly can vary as well. In some implementations, for example, the actuator may be coupled to a ball joint that does not allow for translational movement into and out of the joint housing, but, in those instances, the actuator arm may be adapted to telescope. Additionally, the block can take on any number of shapes and sizes.

Similarly, the engines disclosed herein may utilize different designs for injecting fuel into the combustion chamber. As an example, the engine designs disclosed herein could be adapted to utilize the fuel injection system described in U.S. Patent Application Publication No. US 2011/0259304, the disclosure of which is incorporated herein by reference.

The control of fluid flow (e.g., air intake and exhaust) to and from the engine can vary.

The timing of various events during the engine's operating cycle can vary as well.

The techniques, components and systems disclosed herein can be adapted for use in connection with a variety of different engine styles including, for example, engines that run on diesel fuel or other heavy fuels, engines that run on gasoline or alcohols and engines with or without spark ignition.

Engines implementing the structures and techniques disclosed herein can be used in connection with a wide variety of applications including, for example, aircraft auxiliary power units, alternative light vehicle engines, marine engines, on-highway truck engines, military unmanned aerial vehicles, tactical vehicle engines and aircraft engines.

In various implementations, the structures and techniques disclosed herein can be combined with turbo chargers, superchargers and/or intercoolers.

Finally, features from the various implementations described herein can be combined in a variety of ways.

Many of these "modules" can be stacked along longer crankshafts to make a multi-module engine in the same manner that conventional engines are usually multi-cylinder. There are many different ways to arrange a multi-module CCI.

Accordingly, other implementations are within the scope of the claims.

What is claimed is:

1. An engine comprising:

a stationary first body portion with one or more surfaces that define a portion of a fluid flow path through the engine, the stationary first body portion having a substantially cylindrical outer surface;

a first piston assembly configured to reciprocate relative to the stationary first body portion and to accommodate one or more second piston assemblies reciprocating inside and relative to the first piston assembly;

the first piston assembly having an extension portion, the extension portion having a substantially cylindrical inner surface that defines a space to receive the stationary first body portion; and one or more sealing elements between the substantially cylindrical outer surface of the stationary first body portion and the substantially cylindrical inner surface of the extension portion of the first piston assembly.

2. The engine of claim 1 wherein the extension portion surrounds and reciprocates relative to the stationary first body portion when the first piston assembly reciprocates.

3. The engine of claim 1 further comprising:

one or more valves to control fluid flow through the portion of the fluid flow path defined by the stationary first body portion.

4. The engine of claim 3 wherein the stationary first body portion, the first piston assembly, the one or more sealing elements and the one or more valves cooperate to define an air intake or exhaust chamber for the engine.

5. The engine of claim 4 wherein the air intake or exhaust chamber for the engine has a volume that changes during engine operation as the first piston assembly reciprocates relative to the stationary first body portion.

6. The engine of claim 4 wherein the one or more second piston assemblies comprise two second piston assemblies arranged as opposed pistons inside the first piston assembly, the engine further comprising;

a combustion chamber inside the first piston assembly and between the two second piston assemblies.

7. The engine of claim 6 wherein the first piston assembly comprises:

a substantially annular wall that surrounds the combustion chamber and that defines a combustion chamber fluid port that extends in a substantially radial direction through the substantially annular wall;

a curved shutter outside the substantially annular walk wherein the curved shutter is movable in a circumferential manner about the substantially annular wall between a first position substantially blocking fluid flow through the combustion chamber fluid port and a second position not blocking fluid flow through the combustion chamber fluid port; and an actuator that causes the curved shutter to move between the first position and the second position in response to the first piston assembly reciprocating.

8. The engine of claim 1 further comprising:

one or more circumferential grooves formed in the substantially cylindrical outer surface of the stationary first body portion, wherein each of the one or more sealing elements is coupled to an associated one of the one or more circumferential grooves.

9. The engine of claim 1 wherein the substantially cylindrical outer surface of the stationary first body portion and the substantially cylindrical inner surface of the extension portion of the first piston assembly share a common longitudinal axis.

10. The engine of claim 9 wherein the first piston assembly is configured to reciprocate relative to the stationary first body portion along the common longitudinal axis.

11. The engine of claim 1 wherein the first piston assembly has one or more surfaces that define a fuel injection passage, the engine further comprising:

a fuel injector that is stationary with respect to a casing of the engine and that extends at least partially through the fuel injection passage, wherein the first piston assembly is arranged to move in a reciprocating manner relative to the fuel injector.

12. The engine of claim 1, wherein the engine is a compact compression ignition engine.

13. The engine of claim 1, wherein the stationary first body portion and the extension portion of the reciprocating first piston assembly are configured to collectively define an annular space between the stationary first body portion and the extension portion, wherein the annular space has substantially uniform dimensions from a distal end of the stationary first body portion to a distal end of the extension portion.

14. The engine of claim 1, wherein the extension portion is configured to extend, during engine operation, into the space defined by the substantially cylindrical inner surface of the extension portion with little to no annular space therebetween.

15. The engine of claim 1, wherein the one or more sealing elements are configured to remain substantially stationary, during engine operation, along a longitudinal axis relative to the stationary first body portion.

16. The engine of claim 1, wherein the one or more sealing elements are configured to remain substantially stationary, during engine operation, along a longitudinal axis relative to the stationary first body portion.

17. An engine comprising:

an engine casing;

a first piston assembly configured to reciprocate relative to the engine casing and to accommodate one or more second piston assemblies reciprocating inside and relative to the first piston assembly;

a stationary first body portion at an intake side of the first piston assembly, the stationary first body portion haying one or more surfaces that define a portion of an air inlet path for the engine, the stationary first body portion haying a substantially cylindrical outer surface;

a first extension portion extended from the first piston assembly toward the stationary first body portion, the first extension portion having a surface that defines a substantially cylindrical inner space with an open top, wherein the stationary first body portion extends at least partially through the open top and into the substantially cylindrical inner space of the first extension portion; and one or more first sealing elements between the substantially cylindrical outer surface of the stationary first body portion and a substantially cylindrical inner surface of the first extension portion of the first piston assembly, wherein the first extension portion surrounds and reciprocates relative to the stationary first body portion when the first piston assembly reciprocates.

18. The engine of claim 17 further comprising:

a stationary second body portion at an exhaust side of the first piston assembly, the stationary second body portion haying one or more surfaces that define a portion of an exhaust gas path for the engine, the stationary second body portion having a substantially cylindrical outer surface;

a second extension portion on the first piston assembly, the second extension portion having a surface that defines a substantially cylindrical inner space with an open top, wherein the stationary second body portion extends at least partially through the open top and into the substantially cylindrical inner space of the second extension portion; and one or more second sealing elements between the substantially cylindrical outer surface of the stationary second body portion and a substantially cylindrical inner surface of the second extension portion of the first piston assembly, wherein the second extension portion surrounds and reciprocates relative to the stationary second body portion when the first piston assembly reciprocates.

19. The engine of claim 18 wherein the exhaust side of the first piston assembly is opposite the intake side of the first piston assembly.

20. The engine of claim 18 further comprising:

one or more intake valves to control fluid flow through the portion of the air inlet path defined by the stationary first body portion; and one or more exhaust valves to control fluid flow through the portion of the exhaust path defined by the stationary first body portion.

21. The engine of claim 20 wherein the stationary first body portion, the first extension portion of the first piston assembly, the one or more first sealing elements and the one or more intake valves cooperate to define an air inlet/pre-compression chamber whose volume changes as the first piston assembly reciprocates relative to the engine casing; and wherein the stationary second body portion, the second extension portion of the first piston assembly, the one or more second sealing elements and the one or more exhaust valves cooperate to define an exhaust chamber whose volume changes as the first piston assembly reciprocates relative to the engine casing.

22. The engine of claim 21 wherein the one or more second piston assemblies comprise two second piston assemblies arranged to form opposed pistons inside the first piston assembly, the engine further comprising:

a combustion chamber inside the first piston assembly and between the two opposed pistons.

23. The engine of claim 22 wherein the first piston assembly comprises:

a substantially annular wall that surrounds the combustion chamber and that defines a combustion chamber intake port and a combustion chamber exhaust port, each of which extends through the substantially annular wall;

a curved shutter outside the substantially, annular wall, wherein the curved shutter is movable in a circumferential manner about the substantially annular wall between a first position substantially blocking fluid flow through the combustion chamber intake port but not blocking fluid flow through the combustion chamber exhaust port, and a second position blocking fluid flow through the combustion chamber exhaust port but not blocking fluid flow through the combustion chamber intake port; and an actuator that causes the shutter to move between the first position and the second position in response to the first piston assembly reciprocating.

24. The engine of claim 18 further comprising;

one or more first grooves formed in the substantially cylindrical outer surface of the stationary first body portion, wherein each of the one or more first sealing elements is coupled to an associated one of the one or more first grooves; and one or more second grooves formed in the substantially cylindrical outer surface of the stationary second body portion, wherein each of the one of more second sealing elements is coupled to an associated one of the one or more second grooves.

25. The engine of claim 18 wherein the substantially cylindrical outer surface of the stationary first body portion and the substantially cylindrical inner surface of the first extension portion of the first piston assembly share a first common longitudinal axis, and the first piston assembly is configured to reciprocate relative to the stationary first body portion cylindrical along the first common longitudinal axis, and wherein the substantially cylindrical outer surface of the stationary second body portion and the substantially cylindrical inner surface of the second extension portion of the first piston assembly share a second common longitudinal axis, and the first piston assembly is configured to reciprocate relative to the stationary second body portion cylindrical along the second common longitudinal axis.

26. The engine of claim 25 wherein the first common longitudinal axis and the second common longitudinal axis are identical.

27. The engine of claim 17 wherein the first piston assembly has one or more surfaces that define a fuel injection passage, the engine further comprising:

a fuel injector that is stationary with respect to a casing of the engine and that extends at least partially through the fuel injection passage, wherein the first piston assembly is arranged to move in a reciprocating manner relative to the fuel injector.

28. The engine of claim 17, wherein the engine is a compact compression ignition engine.

29. The engine of claim 17, wherein the stationary first body portion and the first extension portion are configured to collectively define an annular space between the stationary first body portion and the first extension portion, wherein the annular space has substantially uniform dimensions from a distal end of the stationary first body portion to a distal end of the extension portion.

30. The engine of claim 17, wherein the first extension portion is configured to extend, during engine operation, into the space defined by the substantially cylindrical inner surface of the extension portion with little to no annular space therebetween.

* * * * *